US006249270B1

(12) United States Patent
Ito

(10) Patent No.: US 6,249,270 B1
(45) Date of Patent: Jun. 19, 2001

(54) LIQUID CRYSTAL DISPLAY DEVICE, DRIVE CIRCUIT FOR LIQUID CRYSTAL DISPLAY DEVICE, AND METHOD FOR DRIVING LIQUID CRYSTAL DISPLAY DEVICE

(75) Inventor: Takae Ito, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 09/198,952

(22) Filed: Nov. 24, 1998

(30) Foreign Application Priority Data

Dec. 9, 1997 (JP) ..... 9-338850

(51) Int. Cl.[7] ..... G09G 3/36
(52) U.S. Cl. ..... 345/100; 345/98; 345/211
(58) Field of Search ..... 345/211, 212, 345/204, 208, 87, 94, 98, 99, 100

(56) References Cited

U.S. PATENT DOCUMENTS 5,621,439 * 4/1997 Okada et al. ..... 345/211
5,644,332 * 7/1997 Matsuzaki et al. ..... 345/100
5,760,759 * 6/1998 Tanaka et al. ..... 345/211
6,151,007 * 11/2000 Kasai et al. ..... 345/100

FOREIGN PATENT DOCUMENTS 3146992 6/1991 (JP) .
7253764 10/1995 (JP) .
8101398 4/1996 (JP) .
8262402 10/1996 (JP) .

* cited by examiner

*Primary Examiner*—Regina Liang
(74) *Attorney, Agent, or Firm*—Greer, Burns & Crain, Ltd.

(57) ABSTRACT

A liquid crystal display device for displaying a predetermined display data on selected pixels on a liquid crystal display panel is disclosed. The liquid crystal display device includes a maximum amplitude display data detecting unit for detecting the display data corresponding to the maximum drive voltage having a maximum amplitude outputted from a data driver; and a variable output voltage type power source circuit portion for generating a power source voltage to be applied to the data driver and capable of changing the power source voltage based on the result of detection by the maximum amplitude display data detecting unit. The variable output voltage type power source circuit portion selects the power source voltage required for displaying the display data and supplies the selected power source voltage to the data driver for each predetermined period, for example, each one-frame period. A drive circuit for the liquid crystal display device of this configuration and a method for driving the liquid crystal display device by the drive circuit are also disclosed.

18 Claims, 16 Drawing Sheets

LIQUID CRYSTAL DISPLAY DEVICE, DRIVE CIRCUIT FOR LIQUID CRYSTAL DISPLAY DEVICE, AND METHOD FOR DRIVING LIQUID CRYSTAL DISPLAY DEVICE

BACKGROUND OF THE INVENTION

1. Field of the Invention

The present invention relates to a liquid crystal display device having the function of displaying intended display data as image data at selected ones of a plurality of pixels constituting a liquid crystal display panel, a drive circuit for the liquid crystal display device for supplying a power source voltage required for displaying the display data, and a method for driving the liquid crystal display device.

More particularly, the present invention relates to a liquid crystal display device comprising at least one gate driver for sequentially scanning a plurality of pixels through a plurality of first bus lines (generally called scan bus lines), and at least one data driver for supplying a drive voltage for displaying the display data to selected ones of the pixels on the first bus lines through a plurality of second bus lines (generally called data bus lines) crossing the first bus lines, a drive circuit for the liquid crystal display device for supplying the data driver with a power source voltage required for displaying the intended display data by activating the data driver, and a method for driving the liquid crystal display device for supplying the power source voltage to the data driver.

Generally, a portable personal computer such as a notebook-sized personal computer is used with a liquid crystal display device (usually abbreviated to LCD) as a thin and lightweight display device. Especially, in recent years, the notebook-sized personal computer or the like has rapidly prevailed, and opportunities for using various products associated with the notebook-sized personal computer or the like with a liquid crystal display device built therein have increased not only in workshops or offices, but also in various places other than these workshops or offices. Therefore, there is a tendency for high demand for various products to which the liquid crystal display device is applied, using a charge-discharge battery having a longer operation time, and smaller and lighter products to which the liquid crystal display device is applied, having a smaller charge-discharge battery. The current trend is to meet this demand and realize a liquid crystal display device which consumes less power by saving unnecessary power consumption as far as possible.

2. Description of the Related Art

In order to facilitate an understanding of the problems of the conventional liquid crystal display device used with the notebook-sized personal computer and the data driver of the liquid crystal display device, an explanation will be given of an example configuration of the conventional liquid crystal display device used with the notebook-sized personal computer and the operation of the data driver of the liquid crystal display device with reference to FIGS. 1 and 2 as described later in "BRIEF DESCRIPTION OF THE DRAWINGS".

In FIG. 1, a block diagram showing a configuration of a conventional liquid crystal display device is shown. In FIG. 2, a voltage waveform diagram showing the manner in which upper positioned data drivers and lower positioned data drivers, of the conventional type, are controlled is shown. The description that follows refers to a typical case in which the data drivers are divided into those including a first upper positioned data driver 600-1 to an N-th upper positioned data driver 600-N (N: an arbitrary positive integer, hereinafter referred to simply as the upper positioned data drivers) connected to every other second bus line (for example, odd data bus lines) 60*a*, and those including a first lower positioned data driver 610-1 to an N-th lower positioned data driver 610-N (hereinafter referred to simply as the lower positioned data drivers) connected to the remaining every other second bus line (even data bus lines, for example).

The liquid crystal display device shown in FIG. 1 comprises a plurality of first bus lines 50, a plurality of second bus lines 60*a*, 60*b* crossing the first bus lines 50, and a plurality of pixels formed at the intersections of the first and second bus lines on a liquid crystal panel 4 which is configured of a m×n matrix (m, n: arbitrary positive integer). In other words, a plurality of liquid crystal cells constituting a plurality of pixels representing the minimum units of display data are arranged at the intersections of a plurality of first electrodes (row electrodes) X1 to Xm making up the first bus lines 50 (scan bus lines) and a plurality of second electrodes (column electrodes) Y1 to Yn constituting the second bus lines 60*a*, 60*b* (data bus lines).

Further, these pixels are connected to a plurality of transistor switching elements (not shown) made of TFTs (thin film transistors), respectively. These transistor switching elements in turn are connected to a plurality of the second electrodes Y1 to Yn, respectively. Furthermore, control gates for controlling the on-off operation of the transistor switching elements are connected to the first electrodes X1 to Xm, respectively. If it is assumed that the transistor switching elements are turned on and off by applying a predetermined voltage from a plurality of the first electrodes X1 to Xm and a plurality of the second electrodes Y1 to Yn, the same voltage is applied to the corresponding pixels through the transistor switching elements thus turned on, and an electric field is exerted on the liquid crystal in the pixels, and the orientation of the liquid crystal is changed. Thus the intended display data can be displayed as image data.

In FIG. 1, a horizontal arrangement of pixels, i.e. an arrangement of pixels along each scan bus line is called a line. The display data on the liquid crystal panel 4 is written for each scan bus line. This operation is repeated at the rate of 60 times per second, thereby presenting a flickerless image to the eyes of the user. Typically, a liquid crystal display device which has about 640 (n=640) pixels along the horizontal direction (along the scan bus lines) and about 480 (m=480) pixels along the vertical direction (along the data bus lines) of the liquid crystal panel 4, finds wide application. Further, the color display requires additional pixels for R (red), G (green) and B (blue).

The liquid crystal display device further comprises a gate driver 5 for supplying each of the first electrodes X1 to Xm with a gate driver control signal Sxco used for the on-off operation control of the transistor switching elements after being converted to an appropriate voltage level. The gate driver 5 causes all the pixels on the liquid crystal panel 4 to be sequentially scanned through the respective transistor switching elements. There are usually provided a plurality of gate drivers 5 including a plurality of ICs (integrated circuits) connected to the first electrodes X1 to Xm, respectively. In FIG. 1, however, only one gate driver is shown for simplifying the explanation about the gate driver.

On the other hand, the liquid crystal display device comprises data drivers for producing the drive voltages OUT1, OUT2, . . . , OUT(n−1) and OUTn produced by converting the gradational voltage selected in accordance with the data signal of the display data into an appropriate voltage level and supplying them to a plurality of the second electrodes Y1 to Yn. The data drivers usually include upper positioned data drivers 600-1 to 600-N made of 4 to 5 ICs and lower positioned data drivers 610-1 to 610-N made of 4 to 5 ICs (N=4 to 5).

Further, the liquid crystal display device shown in FIG. 1 comprises a control signal generating circuit 300 for generating various control signals including a gate driver control signal Sxco and a data driver control signal Syco for controlling the operation of the gate driver 5, the upper positioned data drivers 600-1 to 600-N and the lower positioned data drivers 610-1 to 610-N in accordance with an external input signal Sin.

Generally speaking, when a DC drive voltage is applied continuously to the liquid crystal, the residual image and the contrast decrease, often deteriorating the quality of the image on display. In order to avoid this image quality deterioration, the liquid crystal in each pixel on the liquid crystal display panel 4 is supplied with such a drive voltage as not to generate any DC component on a temporal average or, for example, an AC drive voltage alternating between positive and negative polarities at regular time intervals. A voltage waveform of the drive voltage outputted from the upper positioned data drivers 600-1 to 600-N (hatched portion in FIG. 2) and a voltage waveform of the drive voltage outputted from the lower positioned data drivers 610-1 to 610-N (hatched portion in FIG. 2) are shown as a typical example of the AC drive voltage in FIG. 2. In this case, the drive voltage outputted from the upper positioned data drivers 600-1 to 600-N and the drive voltage outputted from the lower positioned data drivers 610-1 to 610-N, as viewed at the same time point (t), are related to each other in such a way that when one type of the drive voltage has a positive drive voltage waveform (plus drive voltage waveform), the other type of the drive voltage has a negative drive voltage waveform (minus drive voltage waveform). In this way, the polarities of the two types of drive voltages are opposite to each other. The amplitude and polarity of the drive voltages of the upper positioned data drivers 600-1 to 600-N and the lower positioned data drivers 610-1 to 610-N are controlled by the control signal outputted from the control signal generating circuit 300.

The liquid crystal display device shown in FIG. 1 further comprises a power source circuit 200 for generating a DC output power source voltage Vout required for activating the gate driver 5, the upper positioned data drivers 600-1 to 600-N and the lower positioned data drivers 610-1 to 610-N from an input power source voltage Vin of an external input power source. Further, a power source control circuit 310 is provided for generating a power source control signal Ss for setting an appropriate voltage level of the positive power source voltage (plus (+) power source voltage) +Vs and the negative power source voltage (minus (−) power source voltage) −Vs required for outputting the drive voltages OUT1 to OUTn from the upper positioned data drivers 601-1 to 600-N and the lower positioned data drivers 610-1 to 610-N.

The control signal generating circuit 300, the control circuit portion such as the power source control circuit 310 and the power source circuit portion such as the power source circuit 200 make up a drive circuit for the liquid crystal display device. This drive circuit is usually comprised of one or a plurality of ICs.

The magnitude of the absolute value of the voltage level of the positive power source voltage +Vs and the negative power source voltage −Vs, i.e. the voltage level of the power source voltage applied to the data drivers, as shown in FIG. 2, is normally set to be larger than the maximum amplitude of the drive voltage corresponding to the gradational voltage of the maximum voltage level. In other words, the data drivers are always supplied with a power source voltage higher than the maximum drive voltage in order to output a drive voltage of an arbitrary amplitude.

As described above, the conventional liquid crystal display device is always supplied with a power source voltage of a predetermined voltage level higher than the maximum drive voltage to control the data drivers in accordance with the drive voltage of an arbitrary amplitude. In using a notebook-sized personal computer having this liquid crystal display device built therein, assume that a panel (normal white) is used which is driven by a high voltage in the black display state and by a low voltage in the white display state. In white display state, the amplitude of the actually-outputted drive voltage normally assumes a value smaller than the maximum value of the drive voltage corresponding to the gradational voltage of the maximum voltage level.

In the prior art, however, a comparatively high power source voltage exceeding the maximum value of the drive voltage is normally applied to the data driver even in white display state when the amplitude of the drive voltage is lower than the maximum value thereof. Therefore, the current flows through a plurality of semiconductor devices in the data drivers. As described above, the data drivers include a plurality of ICs, and the total current flowing through the semiconductor devices in the ICs is not negligible. Consequently, unnecessary power consumption in the data driver occurs, thereby making it difficult to realize lower power consumption in the liquid crystal display device.

SUMMARY OF THE INVENTION

The present invention has been developed in view of the above-mentioned problems, and the object thereof is to provide a liquid crystal display device, a drive circuit for the liquid crystal display device and a method for driving the liquid crystal display device capable of realizing the lower power consumption of the whole device by minimizing the unnecessary power consumption in the data drivers.

In order to solve the above-mentioned problems, according to one aspect of the present invention, there is provided a liquid crystal display device comprising:

- a liquid crystal display panel including a plurality of first bus lines, a plurality of second bus lines intersecting the first bus lines and a plurality of pixels formed at the intersections between the first and second bus lines, respectively;
- at least one gate driver for sequentially scanning the pixels through the first bus lines;
- at least one data driver for supplying a drive voltage for displaying a predetermined display data to selected pixels on the first bus lines through the second bus lines;
- a maximum amplitude display data detecting unit for detecting the display data corresponding to a maximum drive voltage having a maximum amplitude of the drive voltage outputted from the data driver; and
- a variable output voltage type power source circuit portion for generating a power source voltage to be applied to the data driver and capable of changing the power source voltage based on the result of detection of the maximum amplitude display data detecting unit.

In such a liquid crystal display device, the variable output voltage type power source circuit portion selects a power source voltage required for displaying the display data at predetermined time intervals and supplies the power source voltage to the data driver.

Preferably, in the liquid crystal display device according to this aspect of the present invention, the power source voltage applied to the data driver is the minimum required one for displaying the display data corresponding to the maximum drive voltage.

Further, preferably, in the liquid crystal display device according to this aspect of the present invention, the display data displayed at the pixels on the liquid crystal display panel are digital data, and the power source voltage is changed, stepwise, in accordance with the signal representing the detection result of the maximum amplitude display data detecting unit and applied to the data driver.

Further, preferably, in the liquid crystal display device according to this aspect of the present invention, the display data displayed at the pixels on the liquid crystal display panel are digital data, and the power source voltage is changed continuously in accordance with the signal produced by digital-to-analog (D/A) conversion of the signal representing the detection result of the maximum amplitude display data detecting unit and is applied to the data driver.

Further, preferably, the variable output voltage type power source circuit portion included in the liquid crystal display device according to this aspect of the present invention selects, for each one-frame period, a power source voltage required for displaying the display data corresponding to a maximum drive voltage having a maximum amplitude of the drive voltage outputted from the data driver and supplies the selected power source voltage to the data driver.

Further, preferably, the variable output voltage type power source circuit portion arranged in the liquid crystal display device according to this aspect of the present invention selects, within each of the first bus lines, i.e. within the one-line period (one scanning period), a power source voltage required for displaying the display data corresponding to the maximum drive voltage having a maximum amplitude outputted from the data driver and supplies the selected power source voltage to the data driver.

On the other hand, consider the case in which the drive circuit of the liquid crystal display device including the maximum amplitude display data detecting unit, the variable output voltage type power source circuit portion and the control circuit portion is formed of ICs separately from the other component elements of the liquid crystal display device. In this case, the drive circuit of the liquid crystal display device has the function of supplying the drive voltage for displaying a predetermined display data through the data driver on a liquid crystal display panel having a plurality of pixels at the intersections between a plurality of first bus lines and a plurality of second bus lines crossing the first bus lines, respectively.

Further, in this case, the drive circuit of the liquid crystal display device, as in the above-mentioned liquid crystal display device, includes a maximum amplitude display data detecting unit for detecting the display data corresponding to the maximum drive voltage having a maximum amplitude outputted from the data driver, and a variable output voltage type power source circuit portion for generating a power source voltage to be applied to the data driver and capable of changing the power source voltage based on the detection result of the maximum amplitude display data detecting unit. This variable output voltage type power source circuit portion, at predetermined time intervals, selects a power source voltage required for displaying the display data and supplies the selected power source voltage to the data driver.

Preferably, in the drive circuit of the liquid crystal display device according to the present invention, the power source voltage supplied to the data driver is the minimum power source voltage required for displaying the display data corresponding to the maximum drive voltage.

Further, preferably, the variable output voltage type power source circuit portion making up the drive circuit of the liquid crystal display device according to the present invention selects, for each one-frame period, a power source voltage required for displaying the display data corresponding to the maximum drive voltage having a maximum amplitude outputted from the data driver and supplies the selected power source voltage to the data driver.

Further, preferably, the variable output voltage type power source circuit portion making up a drive circuit of the liquid crystal display device according to the present invention selects, within each of the first bus lines, a power source voltage required for displaying the display data corresponding to a maximum drive voltage having a maximum amplitude outputted from the data driver and supplies the selected power source voltage to the data driver.

According to another aspect of the present invention, there is provided a method for driving the liquid crystal display device having the above-mentioned drive circuit, comprising the steps of scanning the pixels constituting a liquid crystal display panel through a plurality of first bus lines, supplying selected pixels on the first bus lines with a drive voltage for displaying a predetermined display data from the data driver through a plurality of second bus lines crossing the first bus lines, detecting the display data corresponding to the maximum drive voltage having a maximum amplitude outputted from the data driver, and selecting, at predetermined time intervals, a power source voltage required for displaying the display data based on the detection result of the display data corresponding to the maximum drive voltage, as a source voltage to be applied to the data driver.

Preferably, in the method for driving the liquid crystal display device according to this aspect of the present invention, the power source voltage supplied to the data driver is the minimum power source voltage required for displaying the display data corresponding to the maximum drive voltage.

Further, preferably, in the method for driving the liquid crystal display device according to this aspect of the present invention, the display data are digital data, and the power source voltage is changed, stepwise, in accordance with the signal representing the detection result and supplied to the data driver.

Further, preferably, in the method for driving the liquid crystal display device according to this aspect of the present invention, the display data are digital data, and the power source voltage is continuously changed in accordance with the signal obtained by D/A conversion of the signal representing the detection result and supplied to the data driver.

Further, preferably, the method for driving the liquid crystal display device according to this aspect of the present invention further comprises the step of detecting the display data corresponding to a maximum drive voltage having a maximum amplitude outputted from the data driver, and selecting, for each one-frame period, the power source voltage required for displaying the display data based on the detection result of the display data corresponding to the maximum drive voltage as a power source voltage to be applied to the data driver and supplying the selected power source voltage to the data driver.

Further, preferably, the method for driving the liquid crystal display device according to this aspect of the present invention further comprises the step of detecting the display data corresponding to a maximum drive voltage having maximum amplitude outputted from the data driver, and selecting a power source voltage required for displaying the display data based on the detection result of the display data corresponding to the maximum drive voltage in each of the first bus lines as a power source voltage to be applied to the data driver and supplying the selected power source voltage to the data driver.

With the liquid crystal display device, the drive circuit for the liquid crystal display device and the method for driving the liquid crystal display device according to the present invention, in the case in which the required amplitude of the drive voltage is small, the power source voltage can be changed downward. Therefore, unnecessary power consumption by the data driver is saved and the power consumption of the device as a whole can be reduced.

BRIEF DESCRIPTION OF THE DRAWINGS

The above object and features of the present invention will be more apparent from the following description of the preferred embodiments with reference to the accompanying drawings, wherein.

DESCRIPTION OF THE PREFERRED EMBODIMENTS

Preferred embodiments of the present invention will be described in detail below with reference to the accompanying drawings of FIGS. 3 to 15.

Figure 3:
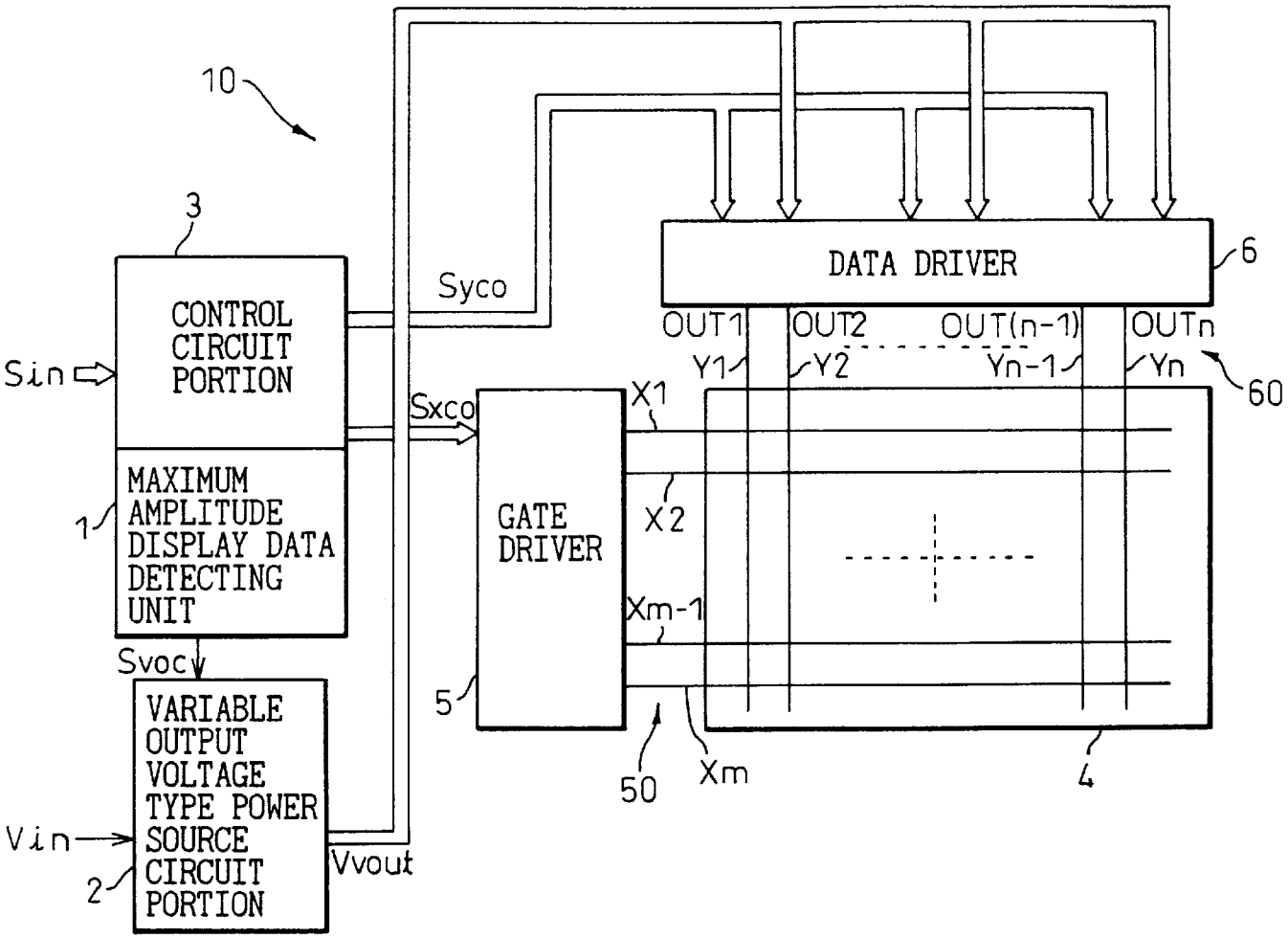
FIG. 3 is a block diagram showing a configuration of a basic embodiment based on the principle of the present invention.

FIG. 3 is a block diagram showing a configuration of a basic embodiment based on the principle of the invention. In FIG. 3, the configuration of a liquid crystal display device 10 is shown in simplified fashion. In the description that follows, the same component elements as those mentioned above will be designated by the same reference numerals, respectively.

As shown in FIG. 3, the liquid crystal display device 10 according to a basic embodiment of the invention comprises a liquid crystal display panel 4 including a plurality of first bus lines (scan bus lines) 50, a plurality of second bus lines (data bus lines) 60 crossing the first bus lines and a plurality of pixels formed at the intersections between the first and second bus lines, respectively; a gate driver 5 for sequentially scanning the pixels through the first bus lines 50; and a data driver 6 for supplying drive voltages OUT1, OUT2, . . . , OUT(n−1), for displaying a predetermined display data, to selected ones of the pixels on the first bus lines 50 through the second bus lines 60.

Figure 1:
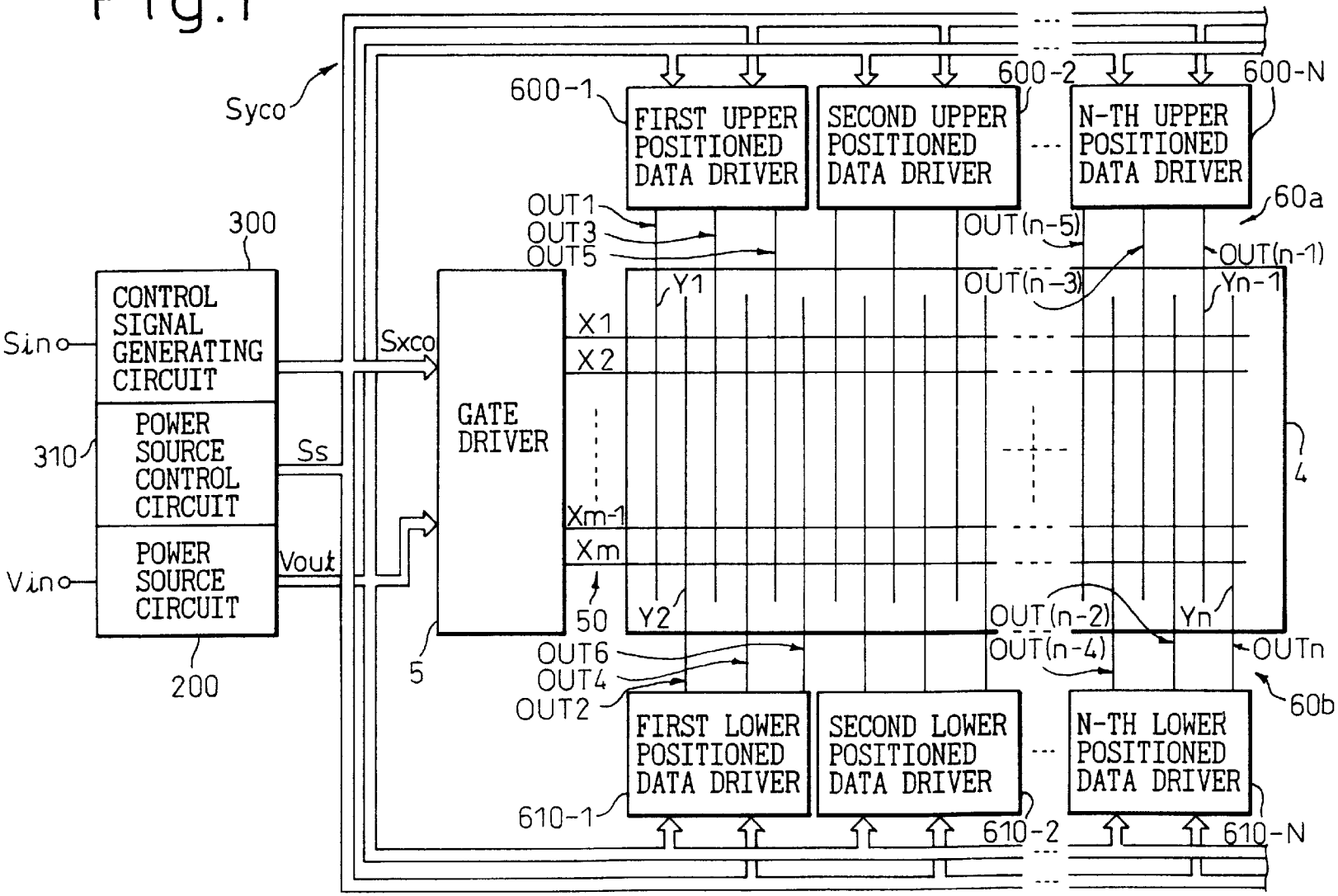
FIG. 1 is a block diagram showing a configuration of a conventional liquid crystal display device.
Figure 2:
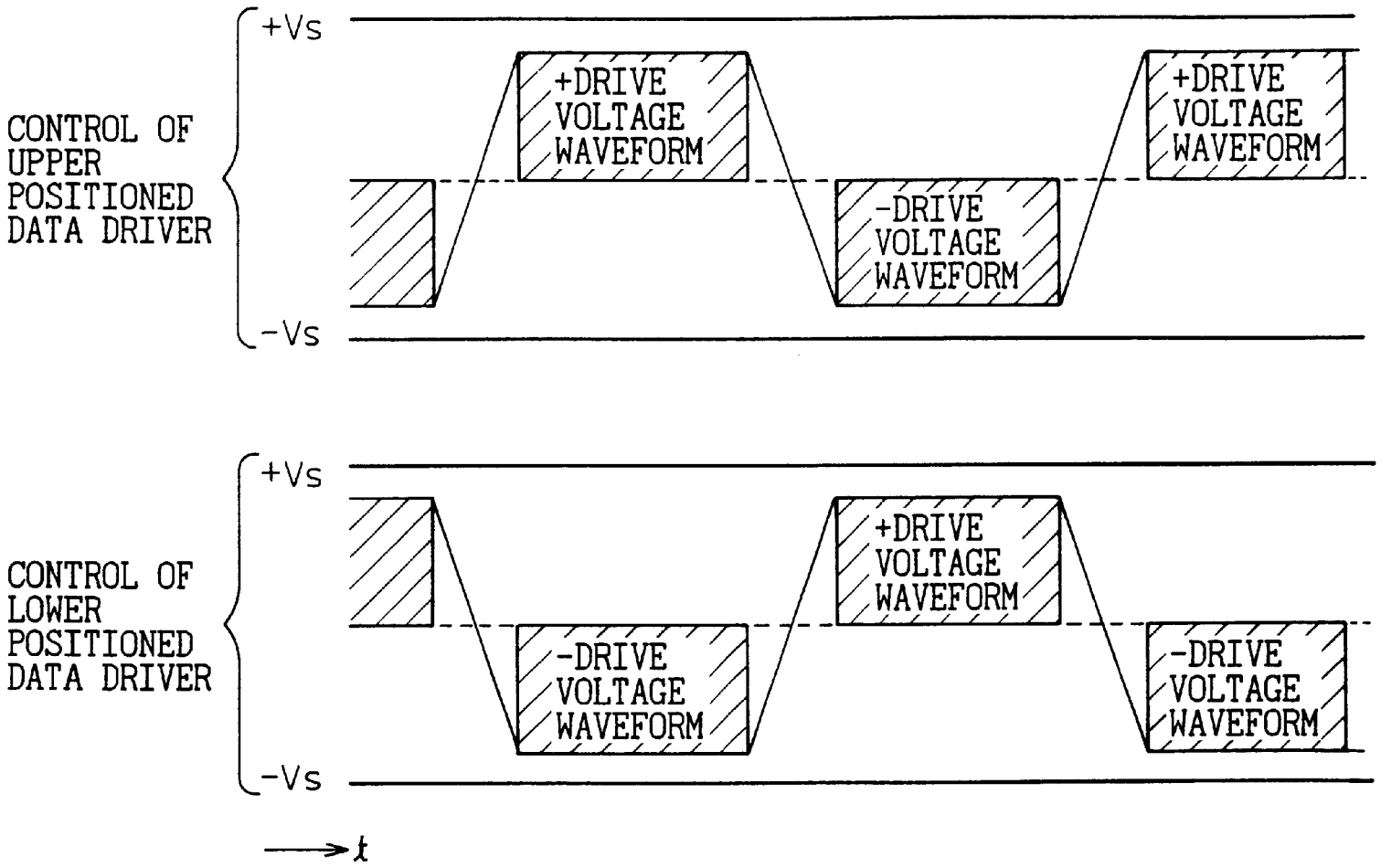
FIG. 2 is a voltage waveform diagram showing the manner in which the upper positioned data drivers and the lower positioned data drivers according to the prior art are controlled.

The gate driver 5 shown in FIG. 3 has the same configuration as the gate driver of the conventional liquid crystal display device. In FIG. 3, however, for simplification of the explanation about the control of the data driver, a data driver 6 in which a plurality of the upper positioned data drivers and a plurality of the lower positioned data drivers are integrated into one data driver as shown in FIG. 1, is illustrated as an example.

Further, the liquid crystal display device 10 shown in FIG. 3 comprises a maximum amplitude display data detecting unit 1 for detecting the display data corresponding to a maximum drive voltage having a maximum amplitude outputted from the data driver 6. The display data corresponding to the maximum drive voltage described above is detected using the data signal of the display data included in an external input signal Sin. The "maximum drive voltage" is defined as an arbitrary voltage level associated with the maximum amplitude of the drive voltage detected within a predetermined period, and it should be noted that the above maximum drive voltage is different from the "maximum value of the drive voltage corresponding to the gradational voltage of the maximum voltage level" described with reference to the prior art.

Also, the liquid crystal display device 10 according to this invention comprises a variable output voltage type power source circuit portion for generating a power source voltage (i.e. an output voltage Vvout) to be applied to the data driver 6 from an input power source voltage Vin and capable of changing the power source voltage based on the output voltage control signal Svoc generated as the result of detection by the maximum amplitude display data detecting unit 1. The variable output voltage type power source circuit portion 2 selects a power source voltage required for displaying the display data at predetermined time intervals and supplies the same to the data driver 6.

Furthermore, the liquid crystal display device 10 shown in FIG. 3 comprises a control circuit portion 3 for generating various control signals including a gate driver control signal Sxco and an upper/lower positioned data driver control signal Syco for controlling the operation of the above-mentioned gate driver 5 and the data driver 6 based on the external input signal Sin. This control circuit portion 3 has substantially the same function as the control signal generating circuit 300 of the conventional liquid crystal display device shown in FIG. 1.

Further, preferably, in the liquid crystal display device of FIG. 3, the power source voltage supplied to the data driver 6 is the minimum power source voltage required for displaying the display data corresponding to the maximum drive voltage.

Further, preferably, in the liquid crystal display device of FIG. 3, the display data displayed on a plurality of pixels on the liquid crystal display panel 4 are digital data, and the power source voltage is changed stepwise and supplied to the data driver 6, in accordance with the signal representing the detection result of the maximum amplitude display data detecting unit 1.

Further, preferably, in the liquid crystal display device of FIG. 3, the display data displayed on a plurality of the pixels on the liquid crystal display panel 4 are digital data, and the power source voltage is continuously changed and supplied to the data driver 6 in accordance with the signal produced by digital-to-analog (D/A) conversion of the signal representing the detection result of the maximum amplitude display data detecting unit 1.

Further, preferably, the variable output voltage type power source circuit portion 2 arranged in the liquid crystal display device of FIG. 3 selects the power source voltage required for displaying the display data corresponding to the maximum drive voltage having a maximum amplitude outputted from the data driver 6 for each one-frame period, and supplies the selected power source voltage to the data driver 6.

Further, preferably, the variable output voltage type power source circuit portion 2 arranged in the liquid crystal display device of FIG. 3 selects the power source voltage required for displaying the display data corresponding to the maximum drive voltage having a maximum amplitude outputted from the data driver 6 in each of the first bus lines 50, i.e. in each one line period (one scanning period) and supplies the selected power source voltage to the data driver 6.

On the other hand, consider the case in which the drive circuit for the liquid crystal display device comprising the maximum amplitude display data detecting unit 1, the variable output voltage type power source circuit portion 2 and the control circuit portion 3 is formed of ICs or the like separately from other component elements of the liquid crystal display device. In this case, the drive circuit for the liquid crystal display device has the function of supplying a drive voltage for displaying a predetermined display data through the data driver 6 to the liquid crystal panel 4 having a plurality of first bus lines and a plurality of pixels at the intersections between a plurality of the first bus lines and a plurality of second bus lines crossing the first bus lines, respectively.

Further, in this case, the drive circuit of FIG. 3, like that of the liquid crystal display device 10 described above, includes maximum amplitude display data detecting unit 1 for detecting the display data corresponding to the maximum drive voltage having a maximum amplitude outputted from the data driver 6, and a variable output voltage type power source circuit portion 2 for generating a power source voltage to be applied to the data driver 6 and capable of changing the power source voltage based on the detection result of the maximum amplitude display data detecting unit 1. The variable output voltage type power source circuit portion 2 selects a power source voltage required for displaying the display data and supplies the selected source voltage to the data driver 6 at predetermined time intervals.

Further, preferably, in the drive circuit for the liquid crystal display device of FIG. 3, the power source voltage supplied to the data driver 6 is the minimum power source voltage required for displaying the display data corresponding to the maximum drive voltage.

Further, preferably, the variable output voltage type power source circuit portion 2 making up the drive circuit of the liquid crystal display device of FIG. 3 selects a power source voltage required for displaying the display data corresponding to the maximum drive voltage having a maximum amplitude outputted from the data driver 6 and applies the selected power source voltage to the data driver 6 for each one-frame period.

Further, preferably, the variable output voltage type power source circuit portion 2 making up the drive circuit of the liquid crystal display device of FIG. 3 selects a power source voltage required for displaying the display data corresponding to the maximum drive voltage having maximum amplitude outputted from the data driver 6, within each of the first bus lines 50, i.e., within one-line period (one scanning period), and supplies the selected power source voltage to the data driver 6.

On the other hand, in the method for driving the liquid crystal display device according to the basic embodiment of the present invention comprising the above-mentioned drive circuit, etc., a plurality of pixels making up a liquid crystal panel are sequentially scanned through a plurality of first bus lines, and a drive voltage for displaying a predetermined display data is supplied from the data driver to the pixels selected on the first bus lines through a plurality of second bus lines crossing the first bus lines. In this case, the display data corresponding to the maximum drive voltage having a maximum amplitude outputted from the data driver is detected, and, as a source voltage to be applied to the data driver, the above-mentioned power source voltage is selected and supplied, at predetermined time intervals, to the data driver as required for displaying the display data based on the detection result of the display data corresponding to the maximum drive voltage.

Preferably, in the method for driving the liquid crystal display device according to the basic embodiment of the present invention, the power source voltage supplied to the data driver is the minimum one required for displaying the display data corresponding to the maximum drive voltage.

Further, preferably, in the method for driving the liquid crystal display device according to the basic embodiment of the present invention, the display data are digital data, and the power source voltage is changed, stepwise, in accordance with the signal representing the detection result and supplied to the data driver.

Further, preferably, in the method for driving the liquid crystal display device according to the basic embodiment of the present invention, the display data are digital data, and the power source voltage is continuously changed in accordance with the signal produced by digital-to-analog conversion of the signal representing the detection result and supplied to the data driver.

Further, preferably, in the method for driving the liquid crystal display device according to the basic embodiment of the present invention, the display data corresponding to the maximum drive voltage having a maximum amplitude outputted from the data driver is detected and, as a power source voltage to be applied to the data driver, the power source voltage required for displaying the display data corresponding to the maximum drive voltage is selected and supplied to the data driver based on the detection result of the display data for each one-frame period.

Further, preferably, in the method for driving the liquid crystal display device according to the basic embodiment of the present invention, the display data corresponding to the maximum drive voltage having a maximum amplitude outputted from the data driver is detected and, as a power source voltage to be applied to the data driver, the power source voltage required for displaying the display data is selected and supplied to the data driver based on the detection result of the display data on each of the first bus lines.

Figure 4:
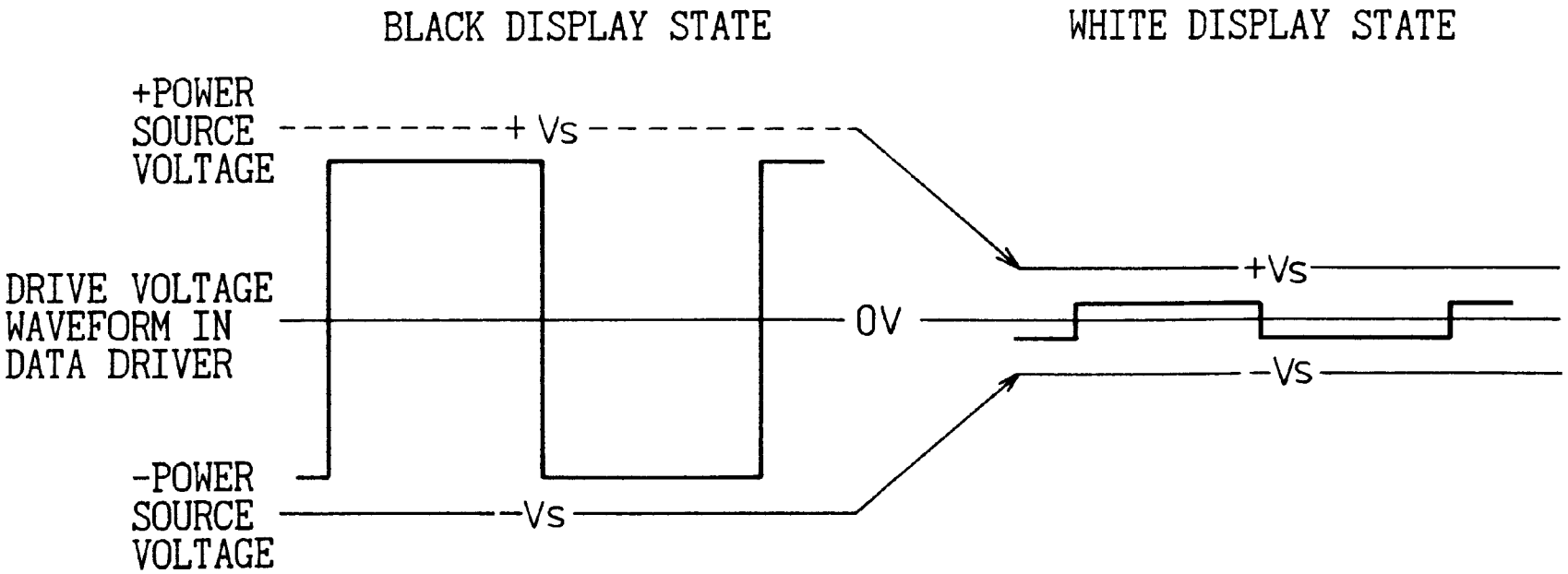
FIG. 4 is a voltage waveform diagram showing the relationship between the power source voltage and the drive voltage for the data drivers for explaining the principle of the present invention.
Figure 5:
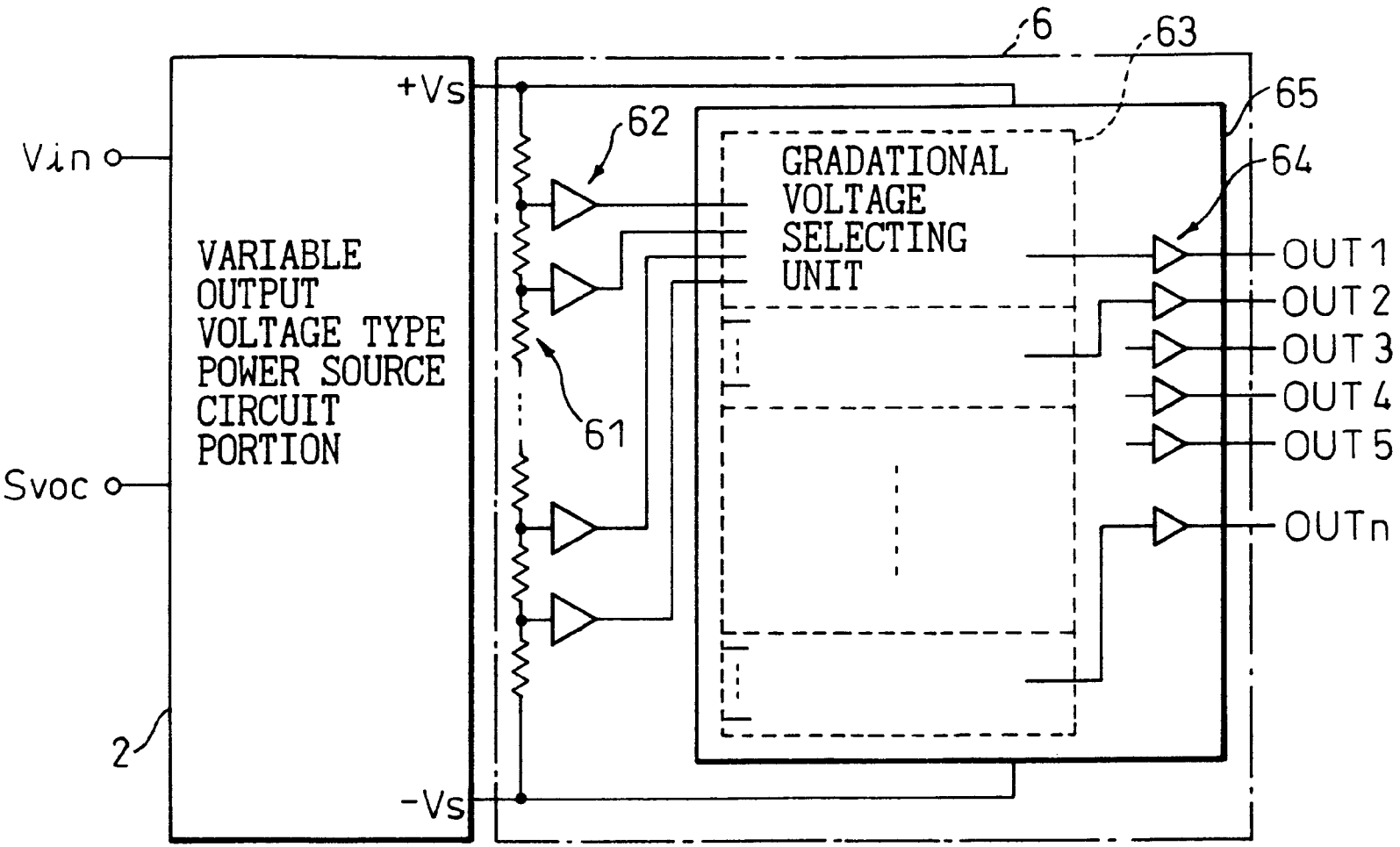
FIG. 5 is a circuit block diagram showing, in an enlarged form, a configuration of the essential parts for explaining the principle of the present invention.

FIG. 4 is a voltage waveform diagram showing the relationship between the power source voltage and the drive voltage of the data driver for explaining the principle of the present invention. FIG. 5 is a circuit block diagram showing, in an enlarged form, a configuration of the essential parts for explaining the principle of the present invention. With reference to FIGS. 4 and 5, the relationship between the drive circuit and the data driver of the liquid crystal display device based on the principle of the present invention will be described in detail.

As shown in FIG. 4, the liquid crystal display device according to this invention generates a positive power source voltage (plus power source voltage) +Vs and a negative power source voltage (minus power source voltage) −Vs capable of being changed in accordance with the drive voltage waveform supplied to the data driver 6 (FIG. 3) as a power source voltage outputted from the variable output voltage type power source circuit portion 2 (FIG. 3).

More specifically, consider a liquid crystal display panel supplied with a small-amplitude drive voltage in a white background of the image on the liquid crystal display panel, i.e. in the white display state or with a large-amplitude drive voltage in the black display state. In black display state during which the image data is displayed in black, the amplitude of the drive voltage increases so that a comparatively high positive power source voltage +Vs and a comparatively high negative power source voltage −Vs are supplied to the data driver. In the white display state during which the image data is displayed in white, in contrast, the amplitude of the drive voltage is reduced as compared with the period of the black display state, so that a comparatively low positive power source voltage +Vs and a comparatively low negative power source voltage −Vs are applied to the data driver. In this way, the maximum amplitude display data detecting unit 1 detects the display data corresponding to the drive voltage having a maximum amplitude during a given period, and the minimum positive power source voltage +Vs and the minimum negative power source voltage −Vs required for displaying the display data are applied to the data driver, thereby suppressing unnecessary power consumption in the data driver.

FIG. 5 shows a basic circuit configuration of the variable output voltage type power source circuit portion and the data driver for realizing the above-mentioned relationship between the power source voltage and the drive voltage. In the variable output voltage type power source circuit portion 2 of FIG. 5, when the positive power source voltage +Vs and the negative power source voltage −Vs are generated from the input power source voltage Vin of an external input power source, the magnitude of the positive power source voltage +Vs and the negative power source voltage −Vs is changed according to an output voltage control signal Svoc associated with the display data corresponding to the drive voltage of maximum amplitude detected by the maximum amplitude display data detecting unit 1 (FIG. 3).

As shown in FIG. 5, the data driver 6 preferably includes a plurality of gamma correction resistors 61 having a plurality of voltage-dividing resistors for regulating the gradational voltage level of the image data, a reference voltage generating unit 62 for generating a plurality of reference voltages corresponding to a plurality of levels of the gradational voltage through a plurality of voltage-dividing resistors and a plurality of input buffers, and a drive voltage generating unit 65 for generating the desired drive voltages OUT1 to OUTn based on the above-mentioned reference voltages and supplying them to each pixel.

Further, the drive voltage generating unit 65 preferably includes a gradational voltage selecting unit 63 for selecting a specific one of the reference voltages and generating the desired gradational voltage in accordance with the display data, and an output buffer unit 64 for converting the gradational voltages into proper voltage levels. The drive voltages OUT1 to OUTn required for displaying the display data are outputted through a plurality of output buffers of the output buffer unit 64. The variable output voltage type power source circuit portion 2 supplies the drive voltage generating unit 65 with the minimum positive power source voltage +Vs and the minimum negative power source voltage −Vs required for displaying the display data for each one-frame period. As an alternative, the minimum positive power source voltage +Vs and the minimum negative power source voltage −Vs required for displaying the display data corresponding to the maximum drive voltage are supplied to the drive voltage generating unit 65 in each one of the first bus lines 60 (FIG. 3).

After all, with the liquid crystal display device, the circuit for driving the liquid crystal display device and the method for driving the liquid crystal display device according to the basic embodiment of the present invention, the power source voltage can be changed downward in the case in which the required amplitude of the drive voltage is small. Therefore, unnecessary power consumption by the data driver is saved, thereby making it possible to reduce the power consumption of the device as a whole.

Figure 6:
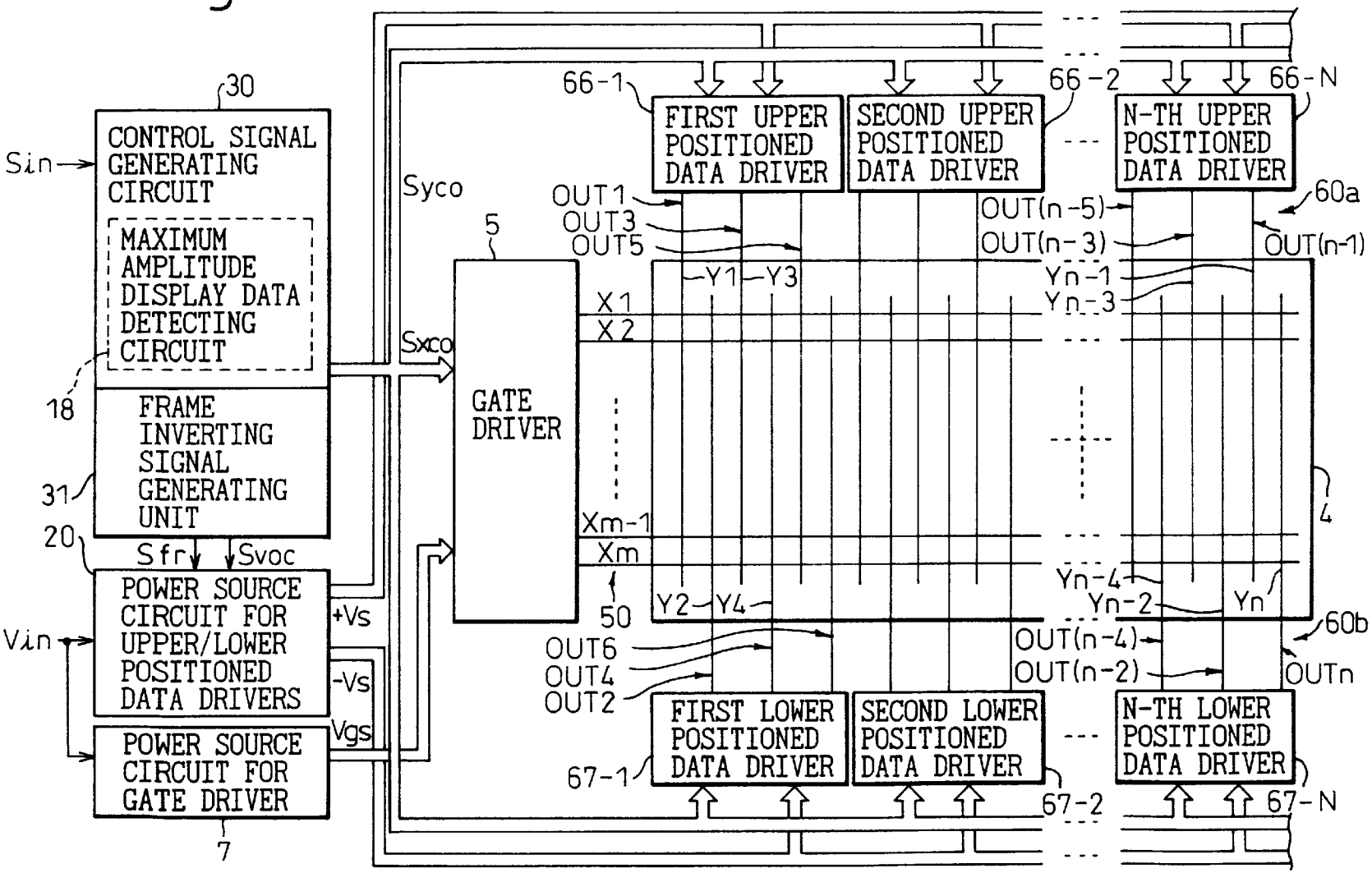
FIG. 6 is a block diagram showing a configuration of a liquid crystal display device according to a first preferred embodiment of the present invention.
Figure 7:
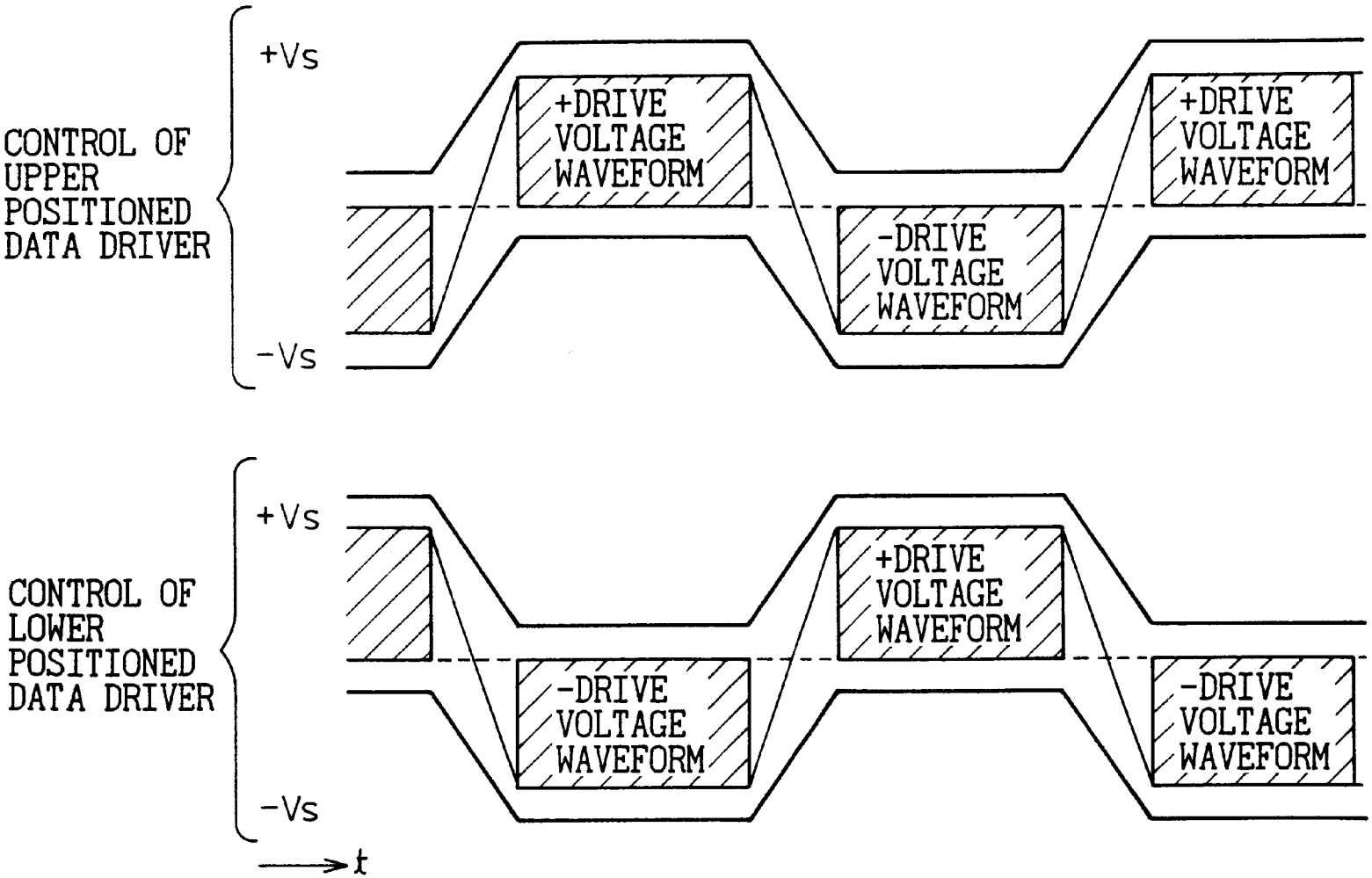
FIG. 7 is a voltage waveform diagram showing the manner in which the upper positioned data drivers and the lower positioned data drivers according to the first preferred embodiment of FIG. 6 are controlled.

FIG. 6 is a block diagram showing a configuration of a liquid crystal display device according to the first preferred embodiment of the present invention, and FIG. 7 is a voltage waveform diagram showing the manner in which an upper positioned data driver and a lower positioned data driver are controlled according to the first preferred embodiment of FIG. 6. This configuration, however, as in the configuration shown in FIG. 1, represents the case in which the data drivers are arranged in two groups, one group including the first upper positioned data driver 66-1 to N-th upper positioned data driver 66-N (hereinafter referred to simply as the upper positioned data drivers) connected to every other one of the second bus lines (odd data bus lines, for example) 60*a*, and the other group including the first lower positioned data driver 67-1 to N-th lower positioned data driver 67-N (hereinafter referred to simply as the lower positioned data drivers) connected to the remaining every other one of the second bus lines (even data bus lines, for example) 60*b*.

In FIG. 6, a plurality of liquid crystal cells representing pixels providing the minimum unit of displaying the intended display data are arranged at the intersections of a plurality of first electrodes X1 to Xm constituting the first bus lines 50 (i.e. the scan bus lines) and a plurality of second electrodes Y1 to Yn constituting the second bus lines 60*a*, 60*b* (i.e. the data bus lines).

Further, the pixels are connected with a plurality of transistor switching elements (not shown) such as TFTs, respectively. Further, the transistor switching elements are connected to the second electrodes Y1 to Yn, respectively. A control gate for controlling the on-off operation of each transistor switching element is connected to each of the first electrodes X1 to Xm.

Furthermore, the liquid crystal display device shown in FIG. 6 includes a gate driver 5 for converting the gate driver control signal Sxco used for controlling the on-off operation of the transistor switching elements and supplying the converted voltage to each of the first electrodes X1 to Xm. This gate driver 5 has the same configuration as the gate driver of the conventional liquid crystal display device shown in FIG. 1. The gate driver 5 enables all the pixels on the liquid crystal display panel 4 to be sequentially scanned through the transistor switching elements.

The liquid crystal display device also includes a data driver for supplying drive voltages OUT1 to OUTn to the second electrodes Y1 to Yn, respectively. In this case, the drive voltages OUT1 to OUTn are produced in such a manner that a specific one of a plurality of reference voltages is selected and a gradational voltage thus generated is converted to an appropriate voltage level in accordance with the data signal of the display data contained in an external input signal Sin. The data driver includes upper positioned data drivers 66-1 to 66-N having four or five ICs and lower positioned data drivers 67-1 to 67-N having four or five ICs. The upper positioned data drivers 66-1 to 66-N and the lower positioned data drivers 67-1 to 67-N have substantially the same configuration as the upper positioned data drivers 600-1 to 600-N and the lower positioned data drivers 610-1 to 610-N, respectively, of the conventional liquid crystal display device shown in FIG. 1. Further, each of the upper and lower positioned data drivers is preferably realized by the circuit configuration shown in FIG. 5. The upper and lower positioned data drivers described above are not constituent components which constitute the features of the present invention, and therefore a detailed description of the circuit configuration of the data driver will be omitted herein.

Further, the liquid crystal display device 10 of FIG. 6 includes a control signal generating circuit 30 for outputting various control signals such as a gate driver control signal Sxco and a data driver control signal Syco for controlling the operation of the gate driver 5, the upper positioned data drivers 66-1 to 66-N and the lower positioned data drivers 67-1 to 67-N. The configuration of the control signal generating circuit 30 is substantially the same as that of the control signal generating circuit 300 of the conventional liquid crystal display device shown in FIG. 1. The control signal generating circuit 30, however, unlike the conventional one shown in FIG. 1, is configured so that the maximum amplitude display data detecting circuit 18 having the function of the maximum amplitude display data detecting means 1 (FIG. 3) is incorporated in the IC constituting the control signal generating circuit 30. The maximum amplitude display data detecting circuit 18 has the function of detecting the display data corresponding to the maximum drive voltage having a maximum amplitude among the voltages OUT1 to OUTn outputted from the upper positioned data drivers 66-1 to 66-N and the lower positioned data drivers 67-1 to 67-N. Further, the power source voltage to be applied to the upper and lower positioned data drivers can be changed according to the output voltage control signal Svoc generated in accordance with the detection result of the maximum amplitude display data detecting circuit 18.

The liquid crystal display device 10 according to the invention shown in FIG. 6 further comprises a variable output voltage type power source circuit portion 2 for generating a power source voltage (i.e. an output voltage Vvout) to be applied to the data driver 6 from an input power source voltage Vin and capable of changing the power source voltage based on the output voltage control signal Svoc generated as a detection result of the maximum amplitude display data detecting means 1. In this variable output voltage type power source circuit portion 2, the minimum power source voltage required for displaying the display data is selected at predetermined time intervals and supplied to the data driver 6.

The voltage waveform of the AC drive voltage (hatched portions of FIG. 7) outputted from the upper positioned data drivers 66-1 to 66-N and the voltage waveform of the AC drive voltage (hatched portions of FIG. 7) outputted from the lower positioned data drivers 67-1 to 67-N are shown in FIG. 7. In this case, the drive voltage outputted from the upper positioned data drivers 66-1 to 66-N and the drive voltage outputted from the lower positioned data drivers 67-1 to 67-N, as viewed at the same time point (t), have opposite polarities to each other. In other words, when one type of the drive voltage has a positive drive voltage waveform (plus drive voltage waveform), the other type of drive voltage has a negative drive voltage waveform (minus drive voltage waveform). The amplitude and polarity of the drive voltage of these upper positioned data drivers 66-1 to 66-N and the lower positioned data drivers 67-1 to 67-N are controlled by the control signal outputted from the control signal generating circuit 30.

Furthermore, as a variable output voltage type power source circuit portion 2 making up a power source circuit portion of the drive circuit according to this invention, the liquid crystal display device of FIG. 6 comprises an upper/lower positioned data driver power source circuit (i.e., power source circuit for upper/lower (positioned data drivers) 20 for generating a positive power source voltage (plus power source voltage) +Vs and a negative power source voltage (minus power source voltage) −Vs to be applied to the upper positioned data drivers 66-1 to 66-N and the lower positioned data drivers 67-1 to 67-N from an input power source voltage Vin of an external input power source. Further, as a power source circuit portion of the drive circuit according to this invention, a gate power source circuit 7 is provided for generating a gate power source voltage of a predetermined voltage level required for operating the gate driver 5 in a stable fashion from the input power source voltage Vin of an external input power source.

In this case, in order to assure the switching between the positive power source voltage +Vs and the negative power source voltage −Vs during each frame period, a frame inverting signal generating unit 31 is provided for generating a frame inversion signal Sfr for inverting the polarity of the power source voltage during each one-frame period. The frame inversion signal Sfr outputted from the frame inverting signal generating unit 31, together with the output voltage control signal Svoc described above, is applied to the upper/lower positioned data driver power source circuit 20.

In addition, the positive power source voltage +Vs and the negative power source voltage −Vs outputted from the upper/lower positioned data driver power source circuit 20, as shown in FIG. 7, are controlled in such a manner that the polarities thereof are switched during each one frame period in accordance with the frame inversion signal Sfr, and at the same time, the magnitude thereof is changed in accordance with the magnitude of the drive voltage.

As is obvious from the voltage waveform diagram of FIG. 7, only the positive drive voltage is outputted from the upper positioned data drivers during a given frame period. Therefore, only the positive power source voltage +Vs is set to a voltage level proximate to the positive drive voltage range, while the negative power source voltage −Vs is set to a low voltage level (about 0 V, for example). Similarly, only the negative drive voltage is outputted from the lower positioned data drivers. Therefore, only the negative power source voltage −Vs is set to a voltage level proximate to the negative drive voltage range, while the voltage level of the positive power source voltage +Vs is set to be relatively low (about 0 V, for example).

During the next frame period, in contrast, only the negative drive voltage is outputted from the upper positioned data drivers. Therefore, only the negative power source voltage −Vs is set to a voltage level proximate to the negative drive voltage range, while the positive power source voltage +Vs is set to a low voltage level. Similarly, only the positive drive voltage is outputted from the lower positioned data drivers, and therefore only the positive power source voltage +Vs is set to a low voltage level proximate to the positive drive voltage range, while the voltage level of the negative power source voltage −Vs is set low.

The method for driving the liquid crystal display device according to this invention can be embodied easily by operating the drive circuit according to the first preferred embodiment described above. In this driving method, taking into consideration the switching of the polarity of the drive voltage outputted from the upper positioned data drivers and the lower positioned data drivers, the display data corresponding to the maximum drive voltage having a maximum amplitude is detected, and on the basis of the detection result of the display data corresponding to the maximum drive voltage, the minimum positive drive voltage and the minimum negative drive voltage required for displaying the display data are selected and applied to the upper positioned data drivers and the lower positioned data drivers during each one frame period.

According to the first embodiment described above, the voltage level of the power source voltage is changed in accordance with the drive voltage range during each one frame period. In the case in which the required amplitude of the drive voltage is small, therefore, a small power source voltage can also be selected. Thus, unnecessary power consumption by the upper and lower positioned data drivers can be saved.

Figure 8A:
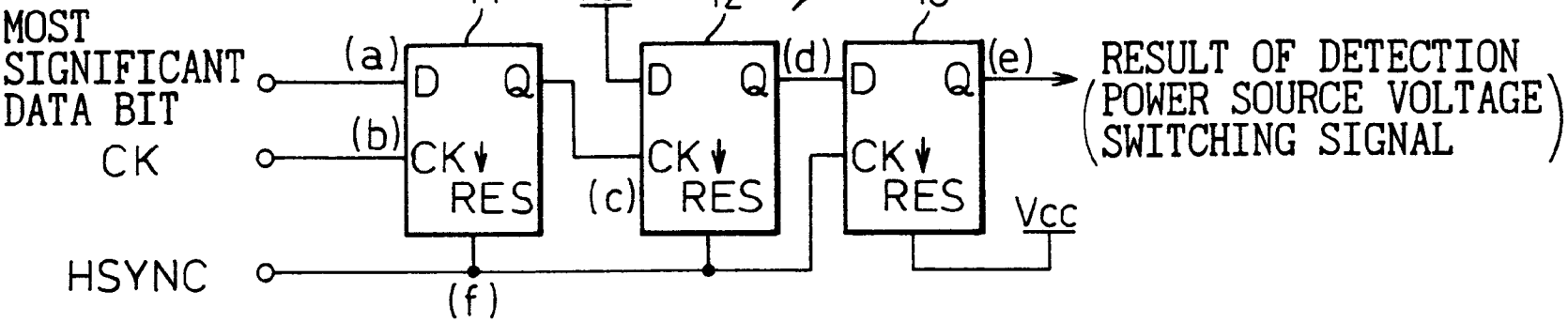
FIGS. 8A and 8B are diagrams showing a configuration of a maximum amplitude display data detecting circuit and voltage waveforms produced at various parts when the power source voltage is switched on the same horizontal bus line, respectively.
Figure 8B:
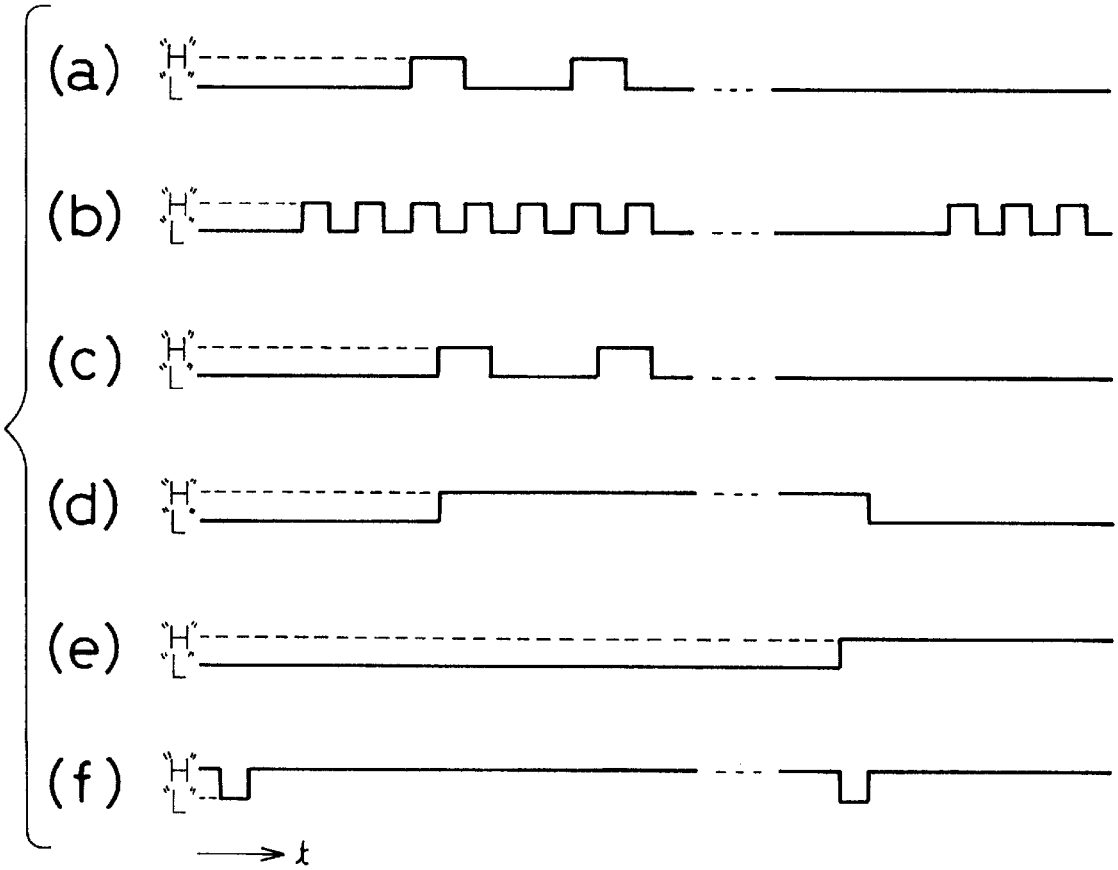

FIGS. 8A and 8B are diagrams showing a configuration of the maximum amplitude display data detecting circuit and voltage waveforms at various parts thereof, respectively, in the case in which the power source voltage is switched on the same horizontal bus line, i.e. on each first bus line.

The maximum amplitude display data detecting circuit 18 shown in FIG. 8A includes three flip-flop circuit portions (FF circuit portions) 11 to 13. In this case, the display data contained in an input signal Sin are digital data. The data signal of several bits (6 bits, for example) representing the digital data are assumed to be inputted to the maximum amplitude display data detecting circuit 18. Reference characters Vcc designates a power source for operating the FF circuit portion, and HSYNC a horizontal sync signal indicating the scanning period for displaying the display data.

In FIG. 8A, first, the most significant data bit of the digital data signal is applied to a data input terminal D of a first-stage FF circuit portion 11 in synchronism with a clock signal CK. The voltage waveform (a) at the data input terminal D and the voltage waveform (b) of the clock signal CK are shown in FIG. 8B. In the case in which the most significant bit of the data signal is "1", as shown in the voltage waveform (c) of FIG. 8B, an "H (high)" signal is outputted from the output terminal (Q) of the first-stage FF circuit portion 11. Specifically, this "H" signal indicates that the voltage level of the drive voltage corresponding to the display data is proximate to the maximum value, i.e. that a substantially maximum display data has been detected. In the case in which the most significant data bit of the data signal is "0", on the other hand, the output level of the output terminal (Q) of the first-stage FF circuit portion 11 remains "L (low)". This "L" signal indicates that the voltage level of the drive voltage corresponding to the display data is about one half of the maximum value.

Further, in FIG. 8A, assume that an "H" signal is produced from the output terminal (Q) of the first-stage FF circuit portion 11. This "H" signal is applied to the clock terminal (CK) of the second-stage FF circuit portion 12. The above-mentioned "H" signal, as shown in the voltage waveform (d) of FIG. 8B, is held in the second-stage FF circuit portion 12 until the scanning of each first bus line is complete. The period during which the "H" signal is held in the second-stage FF circuit portion 12 is defined by applying the horizontal sync signal HSYNC to the reset terminal (RES) of the first- and second-stage FF circuit portions 11, 12 as shown in the voltage waveform (f) of FIG. 8B.

Furthermore, in FIG. 8A, assume that the scanning of a specific bus line is complete and the scanning of the next bus line is started. As shown in the voltage waveform (e) of FIG. 8B, the "H" signal detected on the specific bus line is outputted from the third-stage FF circuit portion 13 as a detection result of the maximum amplitude display data detecting circuit 18. The signal outputted from the third-stage FF circuit portion 13 is used as a power source voltage switching control signal (i.e. the output voltage control signal Svoc) of the upper/lower positioned data driver power source circuit 20 shown in FIG. 9 later. Thus the power source voltage to be applied to the data drivers can be made variable.

Figure 9:
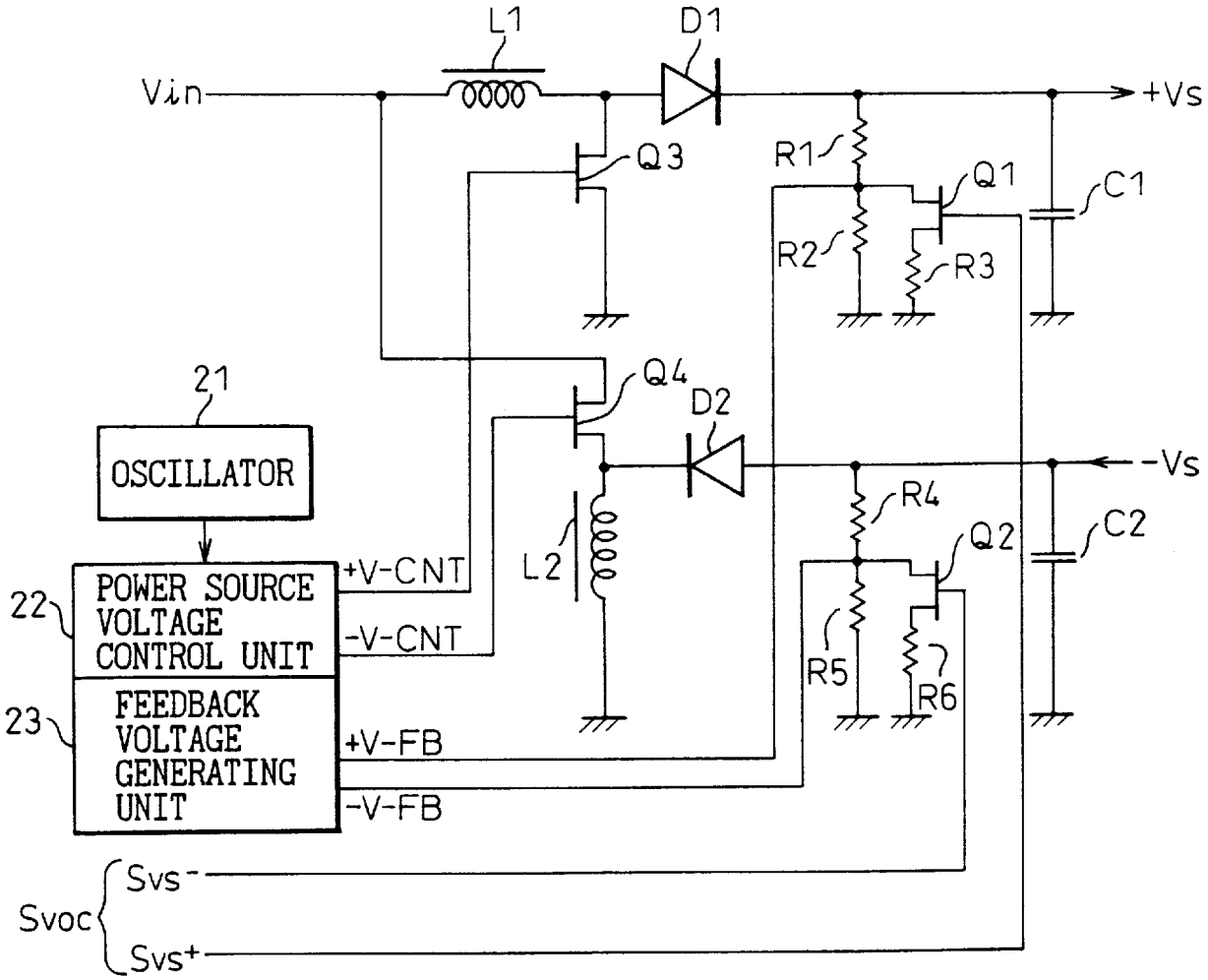
FIG. 9 is a circuit block diagram showing a configuration of a power source circuit for the upper and lower positioned data drivers associated with the maximum amplitude display data detecting circuit of FIG. 8A.
Figure 10:
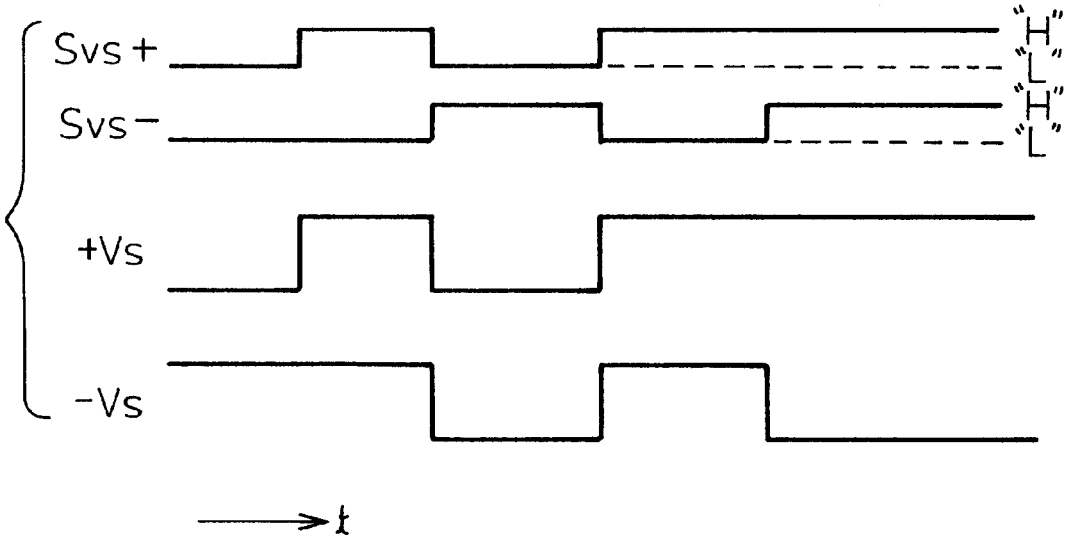
FIG. 10 is a voltage waveform diagram showing the manner in which the power source voltage undergoes a change in FIG. 9.

FIG. 9 is a circuit block diagram showing a configuration of the upper/lower positioned data driver power source circuit associated with the maximum amplitude display data detecting circuit of FIG. 8A. FIG. 10 is a voltage waveform diagram showing the manner in which the power source voltage undergoes a change in FIG. 9.

FIG. 9 shows a specific example of the circuit configuration of the upper/lower positioned data driver power source circuit 20 shown in FIG. 6. As shown in FIG. 9, the upper/lower positioned data driver power source circuit 20 according to this invention makes up a switching regulator circuit for generating a variable positive power source voltage +Vs and a variable negative power source voltage −Vs based on the power source voltage switching control signal produced from the maximum amplitude display data detecting circuit 18 (FIG. 8A) described above.

The upper/lower positioned data driver power source circuit of FIG. 9, i.e. the switching regulator circuit includes switching transistors Q3 and Q4 for generating the positive power source voltage +Vs and the negative power source voltage −Vs, respectively, from the input power source voltage Vin of an external input power source. The switching transistors Q3 and Q4 have attached thereto choke coils L1 and L2, respectively, having the function of smoothing voltages.

Further, the upper/lower positioned data driver power source circuit of FIG. 9 includes a power source voltage control unit 22 for generating a positive power source voltage controlling voltage +V-CNT and a negative power source voltage controlling voltage −V-CNT and supplying them to the input terminals of the switching transistors Q3 and Q4, respectively, based on a reference signal from an oscillator 21. The positive power source voltage controlling voltage +V-CNT changes the level of the input signal of the switching transistor Q3, and thus is used for setting an appropriate voltage level of the positive power source voltage +Vs outputted through a reverse current blocking diode D1. On the other hand, the negative power source voltage controlling voltage −V-CNT changes the level of the input signal of the switching transistor Q4 and thereby is used for setting an appropriate voltage level of the negative power source voltage −Vs outputted through a reverse current blocking diode D2. Further, the output terminals of the switching transistors Q3 and Q4 are connected to capacitors Cl and C2, respectively, for removing the high frequency signal components of the positive power source voltage +Vs and the negative power source voltage −Vs.

Also, the upper/lower positioned data driver power source circuit of FIG. 9 includes a feedback voltage generating unit 23 for generating a positive feedback voltage +V-FB and a negative feedback voltage −V-FB and supplying them to the output terminals of the switching transistors Q3 and Q4. The positive feedback voltage +V-FB is fed back to the input terminal of the switching transistor Q3 as an amount of voltage defined by a pair of voltage-dividing resistors R1 and R2. On the other hand, the negative feedback voltage −V-FB is fed back to the input terminal of the switching transistor Q4 as an amount of voltage defined by a pair of voltage-dividing resistors R4 and R5.

Further, a voltage level regulating resistor R3 for changing the positive feedback voltage is connected in parallel to the voltage-dividing resistor R2 nearer to the positive power source through the switching transistor Q1. On the other hand, a voltage level regulating resistor R6 for changing the negative feedback voltage is connected in parallel to the voltage-dividing resistor R5 nearer to the negative power source through the switching transistor Q2. The on-off operation of the switching transistors Q1, Q2 is controlled by two types of power source voltage switching control signals generated by the maximum amplitude display data detecting circuit 18 (8A), i.e. by a positive power source voltage switching control signal Svs+ and a negative power source voltage switching control signal Svs−, respectively.

For the voltage level of the positive power source voltage +Vs to be changed by the operation of the upper/lower positioned data driver power source circuit of FIG. 9, the switching transistor Q1 is turned on by turning the level of the positive power source voltage switching signal Svs+ to "H" level. In this way, the turning on of the switching transistors Q1 causes the voltage level regulating resistor R3 and the voltage-dividing resistor R2 to be connected in parallel to each other. The combined resistance of the voltage level regulating resistor R3 and the voltage-dividing resistor R2 changes the voltage level of the positive feedback voltage +V-FB, thereby changing the positive power source voltage +Vs in steps.

On the other hand, if the voltage level of the negative power source voltage −Vs is to be changed, as shown in FIG. 10, the level of the negative power source voltage switching signal Svs− is raised to H, and the switching transistor Q2 is turned on. In this way, by turning on the switching transistor Q2, the voltage level regulating resistor R4 and the voltage-dividing resistor R2 are connected in parallel with each other. The combined resistance of the voltage level regulating resistor R6 and the voltage-dividing resistor R5 causes the voltage level of the negative feedback voltage to undergo a change so that the negative power source voltage −Vs is changed in steps.

Figure 11:
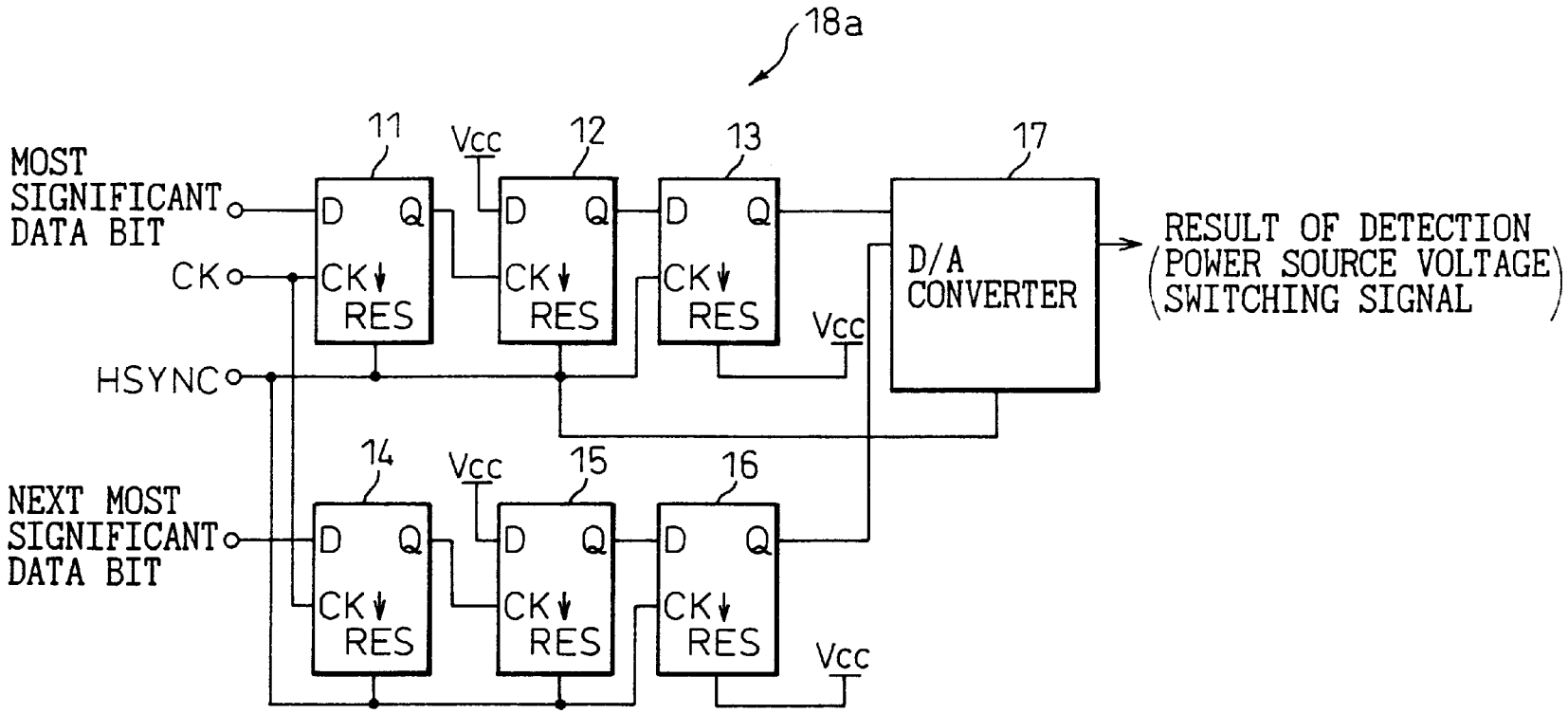
FIG. 11 is a circuit block diagram showing a configuration of the maximum amplitude display data detecting circuit used for detecting a multi-bit digital data and converting the same into analog data.

FIG. 11 is a circuit block diagram showing a configuration of the maximum amplitude display data detecting circuit used for detecting a multi-bit digital data and converting the same into an analog data. In this case, for facilitating an understanding, a maximum amplitude display data detecting circuit is illustrated in which 4-bit data is detected by detecting the values of the most significant data bit and the next most significant data bit.

The maximum amplitude display data detecting circuit 18*a* for detecting the 4-bit digital data shown in FIG. 11 includes six flip-flop circuit portions (FF circuit portions) 11 to 16, and a digital/analog converter (D/A converter) 17 for subjecting the power source voltage switching signal indicating the detection result of the FF circuit portions 11 to 16 to digital/analog (D/A) conversion.

In FIG. 11, the configuration and operation of the FF circuit portions 11 to 13 for detecting the most significant bit of the data signal indicating the display data are identical to those of the FF circuit portion of FIG. 8A described above, and will not be described.

Further, in FIG. 11, the lower FF circuit portions 14 to 16 for detecting the next most significant data bit of the data signal are connected in parallel to the upper FF circuit portions 11 to 13 for detecting the most significant data bit. The next most significant data bit is applied to the data input terminal D of the lower first-stage FF circuit portion 14 in synchronism with the clock signal CK. In the case in which the next most significant data bit of the data signal is "1", an "H" signal is outputted from the output terminal (Q) of the lower first-stage FF circuit portion 14. In the case where the next most significant data bit of the data signal is "0", on the other hand, the output level of the output terminal (Q) of the lower first-stage FF circuit portion 14 remains "L".

Further, in FIG. 11, in the case in which an "H" signal is outputted from the output terminal (Q) of the low first-stage FF circuit portion 14, the "H" signal is applied to the clock terminal (CK) of the lower second-stage FF circuit portion 15. This "H" signal is held in the lower second-stage FF circuit portion 15 until the scanning of each first line bus is complete. The period during which the H signal is held in the second-stage FF circuit portion 15 is defined by applying the horizontal sync signal HSYNC to the reset terminal (RES) of the FF circuit portions 14, 15.

Furthermore, in FIG. 11, when the scanning of a specific bus line is complete and the scanning of the next bus line is started, the H signal detected on the specific bus line is outputted from the lower third-stage FF circuit portion 16 as a detection result of the maximum amplitude display data detecting circuit 18*a*. The signal outputted from the third-stage FF circuit portion 16, together with the signal outputted from the upper third-stage FF circuit portion 13, is subjected to digital-to-analog conversion by the D/A converter 17. The signal outputted from the D/A converter 17 is used as a power source voltage switching control signal for the upper/lower positioned data driver power source circuit 20 shown in FIG. 10 thereby making it possible to change, substantially continuously, the power source voltage to be applied to the data driver.

Figure 12:
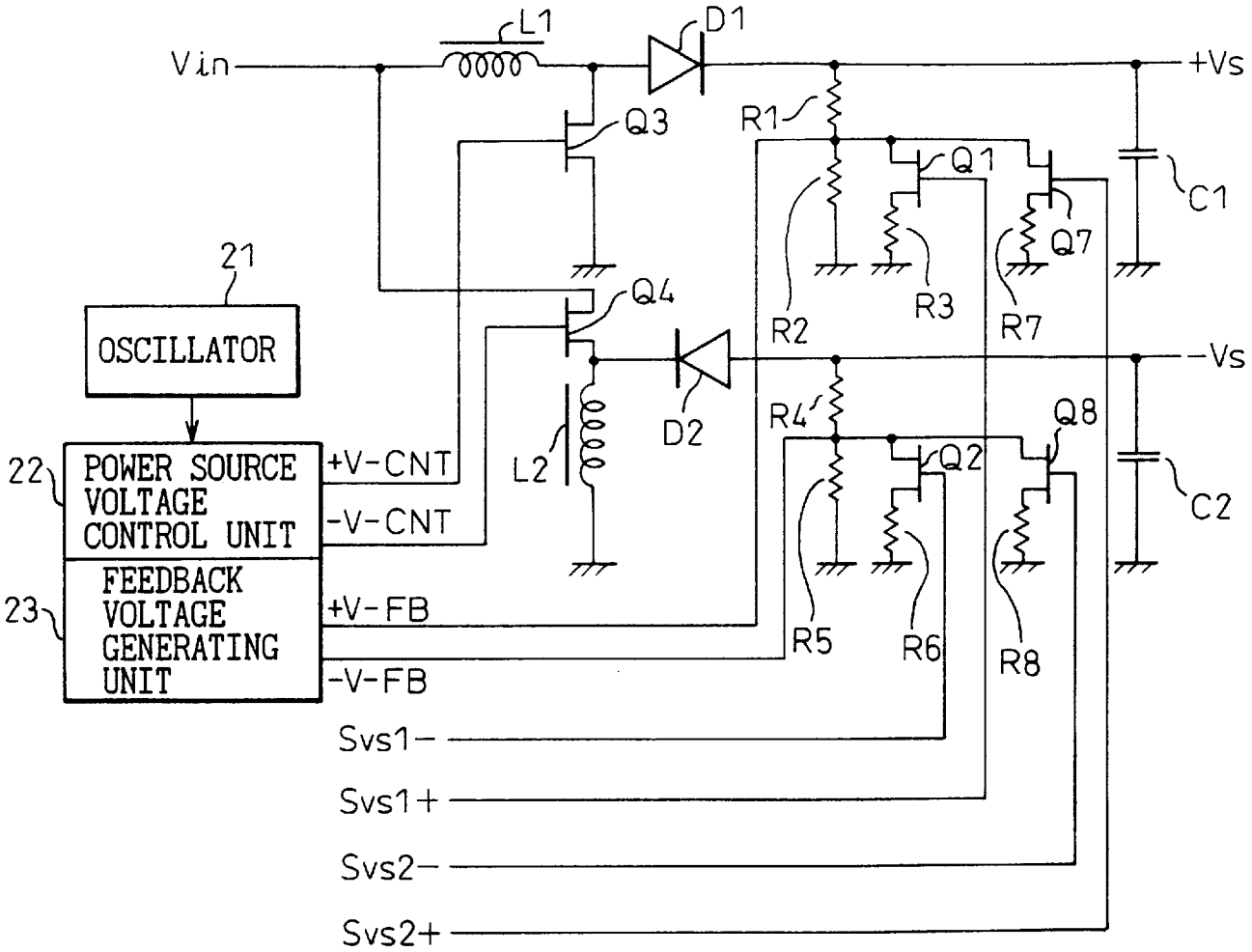
FIG. 12 is a circuit block diagram showing a configuration of a power source circuit for upper and lower positioned data drivers associated with the maximum amplitude display data detecting circuit of FIG. 11.

FIG. 12 is a circuit block diagram showing a configuration of the upper/lower positioned data driver power source circuit associated with the maximum amplitude display data detecting circuit of FIG. 11.

The upper/lower positioned data driver power source circuit shown in FIG. 12 is substantially identical to that of FIG. 9, except that switching transistors Q7, Q8 and voltage level regulating resistors R7, R8 are added to the upper/lower positioned data driver power source circuit of FIG. 9.

The switching transistors Q7, Q8 and the voltage level regulating resistors R7, R8 described above are newly added for changing the positive feedback voltage and the negative feedback voltage in accordance with the detection result of the most significant bit and the next most significant bit of the data signal.

In FIG. 12, as in the case of FIG. 9, the upper/lower positioned data driver power source circuit includes a feedback voltage generating unit 23 for generating a positive feedback voltage +V-FB and a negative feedback voltage −V-FB and supplying them to the output terminals of the switching transistors Q3, Q4, respectively. In this case, the positive feedback voltage +V-FB is fed back to the input terminal of the switching transistor Q3 by an amount equivalent to the voltage defined by a pair of voltage-dividing resistors R1, R2. On the other hand, the negative feedback voltage −V-FB is fed back to the input terminal of the switching transistor Q4 by an amount equivalent to the voltage defined by a pair of voltage-dividing resistors R4, R5.

Further, in FIG. 12, a voltage level regulating resistor R3 for changing the positive feedback voltage is connected in parallel to the voltage-dividing resistor R2 on the positive power source side through the switching transistor Q1, and the other voltage level regulating resistor R7 is connected in parallel to the voltage-dividing resistor R2 on the positive power source side through the switching transistor Q7. On the other hand, a voltage level regulating resistor R6 for changing the negative feedback voltage is connected in parallel to the voltage-dividing resistor R5 on the negative power source side through the switching transistor Q2, while the other voltage level regulating resistor R8 is connected in parallel to the voltage-dividing resistor R5 on the negative power source side through the switching transistor Q8.

The on-off operation of the switching transistors Q1 and Q2 is controlled by four types (2 bits) of analog power source voltage switching control signals generated by the maximum amplitude display data detecting circuit 18*a* (FIG. 11), etc., respectively. These four types of power source voltage switching control signals include a first positive power source voltage switching control signal Svs1+ and a first negative power source voltage switching control signal Svs1− produced as the result of detecting the most significant bit of the data signal on the one hand, and a second positive power source voltage switching control signal Svs2+ and a second negative power source voltage switching control signal Svs2− produced as the result of detecting the next most significant data bit of the data signal on the other hand.

For the voltage level of the positive power source voltage +Vs to be continuously (in four ways in the case under consideration) changed by the operation of the upper/lower positioned data driver power source circuit, the level of the first positive power source voltage switching signal Svs1+ is raised to "H" thereby to turn on the switching transistor Q1, or the level of the second positive power source voltage switching signal Svs2+ is raised to "H" and the switching transistor Q7 is turned on. In this way, by turning on the switching transistor Q1 or the switching transistor Q7, the relationship concerning a parallel connection between the voltage-dividing resistor R2, the voltage level regulating resistor R3 and the voltage level regulating resistor R7, is changed. The combined resistance of the voltage-dividing resistor R2, the voltage level regulating resistor R3 and the voltage level regulating resistor R7 causes the voltage level of the positive feedback voltage +V-FB to change substantially continuously, with the result that the positive power source voltage +Vs changes substantially continuously.

On the other hand, for the voltage level of the negative power source voltage −Vs to be changed in four ways, the level of the first negative power source voltage switching signal Svs1− is raised to "H" and the switching transistor Q2 is turned on, or the level of the second negative power source voltage switching signal Svs2− is raised to "H" and the switching transistor QB is turned on. By turning on the switching transistor Q2 or the switching transistor Q8 in this way, the relationship concerning a parallel connection between the voltage-dividing resistor R5, the voltage level regulating resistor R6 and the voltage level regulating resistor R8, is changed. The combined resistance of the voltage-dividing resistor R5, the voltage level regulating resistor R6 and the voltage level regulating resistor R8 causes the voltage level of the negative feedback voltage −V-FB to change substantially continuously, so that the negative power source voltage −Vs changes substantially continuously.

Figure 13:
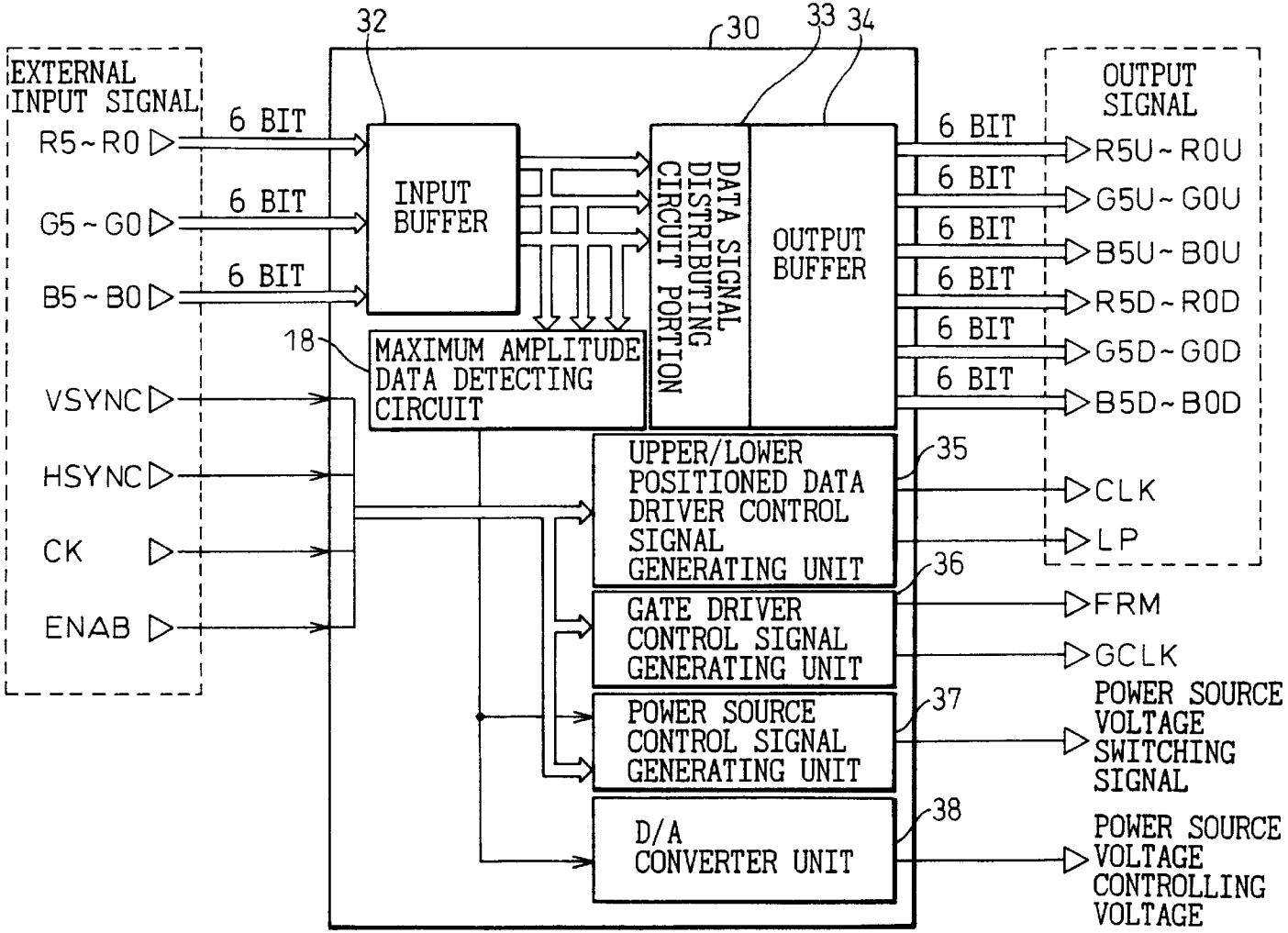
FIG. 13 is a circuit block diagram showing in detail a control signal generating circuit used in the first preferred embodiment of the present invention.

FIG. 13 is a detailed circuit block diagram showing the control signal generating circuit used in the first preferred embodiment of the invention. It is assumed here that the amplitude and polarity of the drive voltage are controlled as required for displaying the display data corresponding to the pixels of the three primary colors of R (red), G (green) and B (blue) for color display.

The external input signal Sin inputted to the control signal generating circuit of FIG. 13 includes 6-bit red data signals R5 to R0 indicating the display data corresponding to red pixels, 6-bit green data signals G5 to G0 indicating the display data corresponding to green pixels, 6-bit blue data signals B5 to B0 indicating the display data corresponding to blue pixels, a vertical sync signal VSYNC, a horizontal sync signal HSYNC, a clock signal CK and an enable signal ENAB.

The control signal generating circuit shown in FIG. 13 includes a data signal distributing circuit portion 33 for distributing the red data signals R5 to R0, the green data signals G5 to G0 and the blue data signals B5 to B0 among a plurality of upper positioned data drivers and lower positioned data drivers. The above-mentioned three types of data signals are applied through an input buffer 32 to the data signal distributing circuit portion 33, and then converted into an appropriate signal level through an output buffer 34. Further, in order to control the operation of the upper positioned data drivers, upper positioned data driver control signals R5U to R0U associated with the red data, upper positioned data driver control signals G5U to G0U associated with the green data and upper positioned data driver control signals B5U to B0U associated with the blue data are produced from the output buffer 34 as output signals of the control signal generating circuit (i.e. the data driver control signal Syco). Similarly, in order to control the operation of the lower positioned data drivers, lower positioned data driver control signals R5D to R0D associated with the red data, lower positioned data driver control signals G5D to G0D associated with the green data and lower positioned data driver control signals B5D to B0D associated with the blue data are outputted from the output buffer 34 as output signals of the control signal generating circuit.

Further, the control signal generating circuit of FIG. 13 includes an upper/lower positioned data driver control signal generating unit 35 for generating a data clock CLK for assuring synchronism with the upper positioned data driver control signal and the lower positioned data driver control signal and a latch pulse LP for temporarily holding the upper positioned data driver control signal and the lower positioned data driver control signal for indicating the display data for each scan bus line. The control clock pulse CLK and the latch pulse LP are generated on the basis of the vertical sync signal VSYNC, the clock signal CK and the enable signal ENAB contained in the input signal Sin.

Furthermore, the control signal generating circuit of FIG. 13 includes a gate driver control signal generating unit 36 for generating a frame signal FRM for defining a one-frame period and a gate clock GCLK for assuring synchronism between the various signals associated with the operation of the gate driver, as a gate driver control signal Sxco for controlling the operation of the gate driver. In this case, the frame signal FRM and the gate clock GCLK are generated on the basis of the horizontal sync signal HSYNC, the clock signal CK and the enable signal ENAB contained in the input signal Sin.

In addition, the control signal generating circuit of FIG. 13 includes a power source control signal generating unit 37 for generating at least two types of power source voltage switching control signals such as the positive power source voltage switching control signal Svs+ and the negative power source voltage switching control signal Svs− as described above.

What is more, the control signal generating circuit includes therein a D/A converter unit 38 for generating at least two types of power source voltage controlling voltages such as the positive power source voltage controlling voltage +V-CNT and the negative power source voltage controlling voltage −V-CNT.

Further, in FIG. 13, the maximum amplitude display data detecting circuit 18 having the configuration shown in FIG. 8A is incorporated in the IC making up the control signal generating circuit. This maximum amplitude display data detecting circuit 18 is for detecting the display data corresponding to the maximum drive voltage having a maximum amplitude outputted from the upper positioned data drivers and the lower positioned data drivers based on the data signals including the red data signals R5 to R0, the green data signals G5 to G0 and the blue data signals B5 to B0. Furthermore, the power source voltages to be applied to the upper positioned data drivers and the lower positioned data drivers are changed by controlling the power source voltage switching control signal and the power source voltage controlling voltage appropriately based on the output voltage control signal representing the detection result of the maximum amplitude display data detecting circuit 18.

Figure 14:
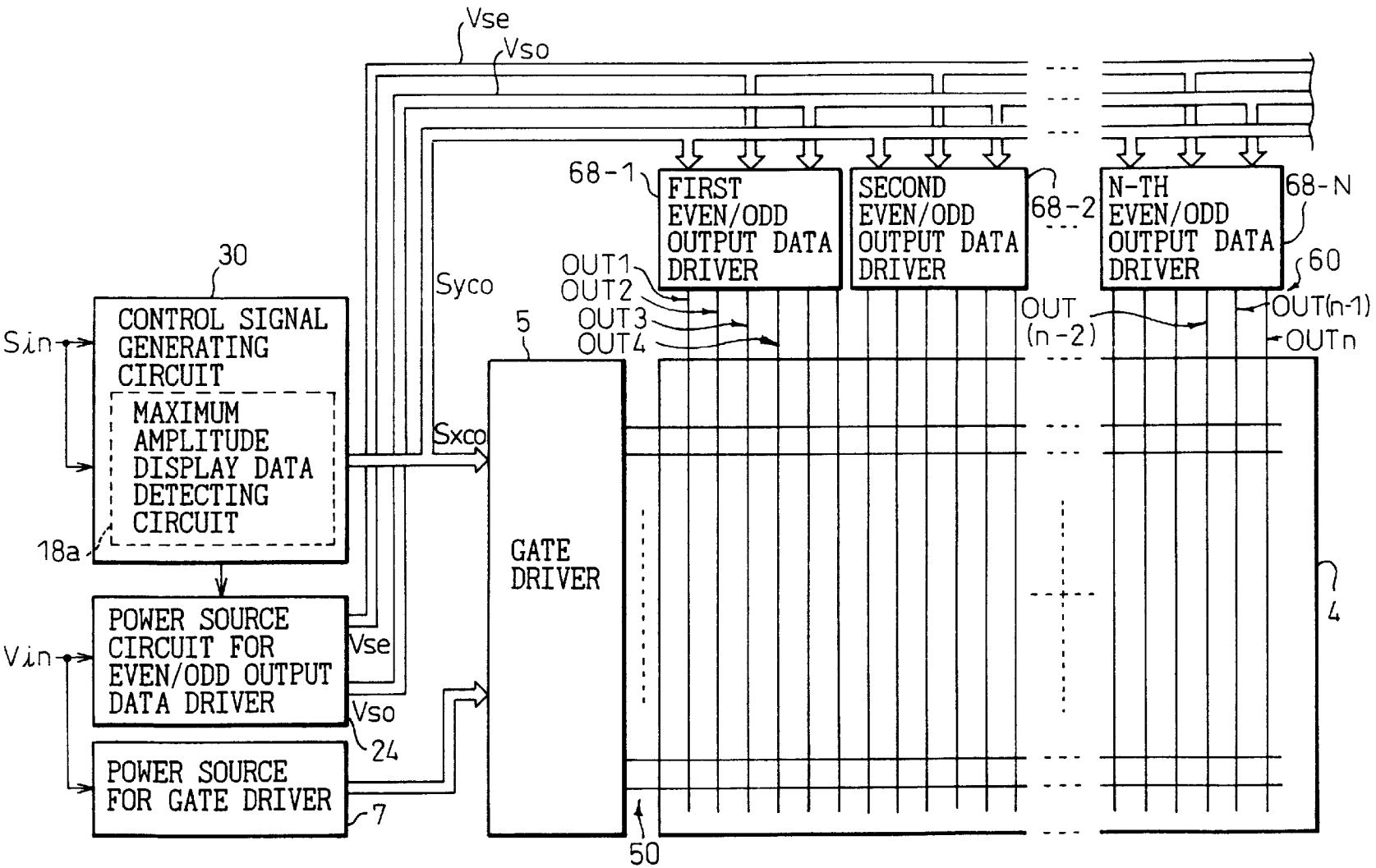
FIG. 14 is a block diagram showing a configuration of the liquid crystal display device according to a second preferred embodiment of the present invention.
Figure 15:
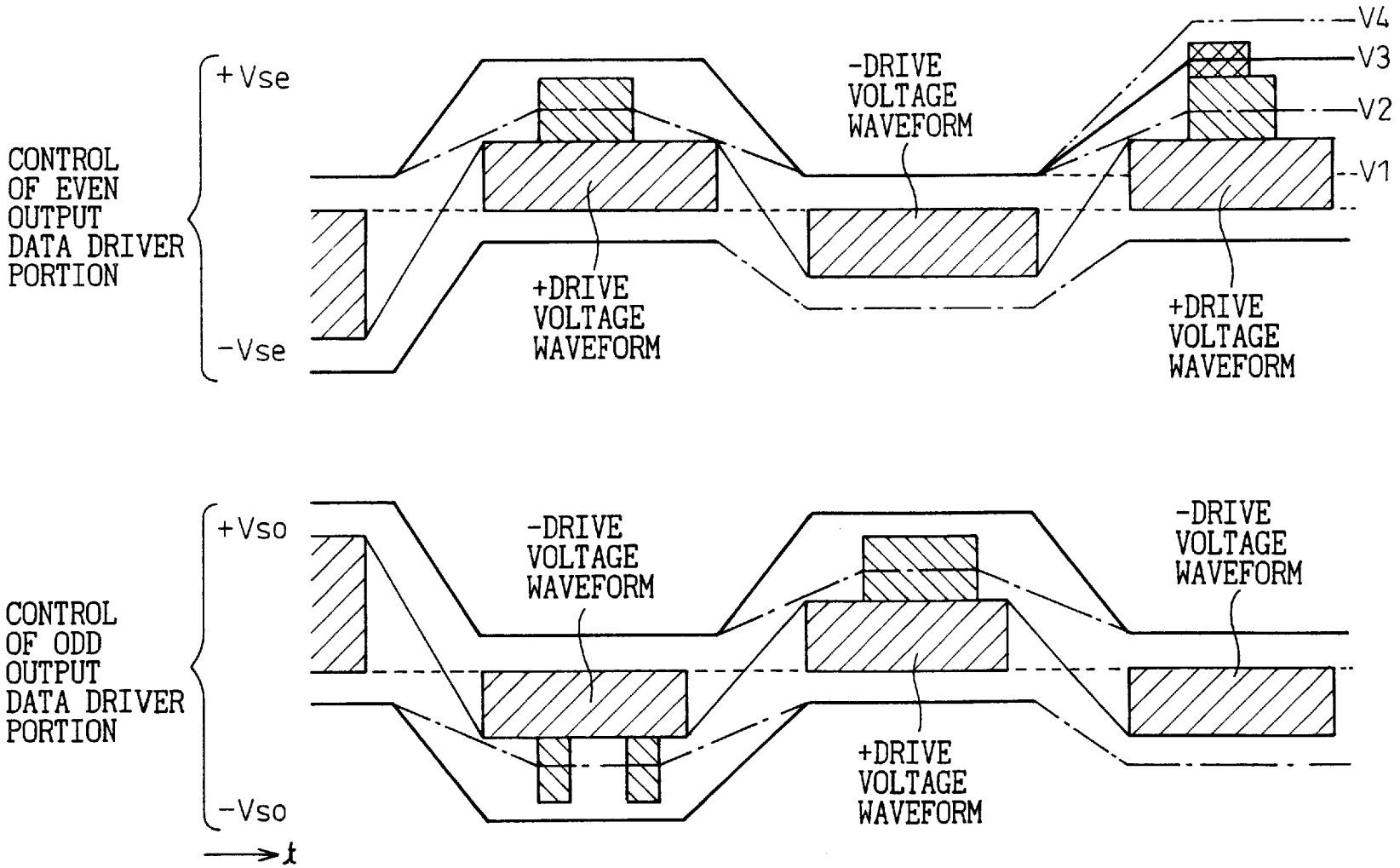
FIG. 15 is a voltage waveform diagram showing the manner in which an even output data driver and an odd output data driver according to the second preferred embodiment of FIG. 14.

FIG. 14 is a block diagram showing a configuration of a liquid crystal display device according to a second preferred embodiment of the present invention. FIG. 15 is a voltage waveform diagram showing the manner in which the even output data driver unit and the odd output data driver unit of the second preferred embodiment shown in FIG. 14 are controlled. This case, however, assumes that the maximum amplitude display data detecting circuit 18*a* for detecting a multi-bit digital data shown in FIG. 11 is incorporated in the control signal generating circuit.

In the second preferred embodiment shown in FIG. 14, the data drivers are not separated into the upper positioned data drivers and the lower positioned data drivers on the two sides of the second bus line (i.e. the data bus line) 60 (See the first preferred embodiment of FIG. 6). Instead, the data drivers are arranged only on one side of the second bus line 60. The data drivers according to the second preferred embodiment include a first even/odd output data driver 68-1 to an N-th even/odd output data driver 68-N (hereinafter simply called the even/odd output data drivers) each connected to a plurality of data bus lines and preferably include four to five ICs. In this case, each of the even/odd output data drivers is divided into an even output data driver unit connected to an even data bus line and an odd output data driver connected to an odd data bus line.

The liquid crystal display device according to the second preferred embodiment shown in FIG. 14 further comprises an even/odd output data driver power source circuit 24 for generating an even output data driver power source voltage Vse and an odd output data driver power source voltage Vso from an input power source voltage Vin of an external input power source and supplying them to a plurality of even output data drivers 68-1 to 68-N. In this case, the even output data driver power source voltage Vse is applied to the even output data driver unit and the odd output data driver power source voltage Vso is applied to the odd output data driver unit. In other words, according to the above-mentioned second embodiment, different source voltages are supplied to the even output data driver unit and the odd output data driver unit.

Further, according to the second preferred embodiment shown in FIG. 14, the maximum amplitude display data detecting circuit 18*a* shown in FIG. 11 is incorporated in the IC making up the control signal generating circuit 30. The maximum amplitude display data detecting circuit 18*a* is for detecting the display data corresponding to the maximum drive voltage having a maximum amplitude among the drive voltages OUT1 to OUTn outputted from a plurality of even/odd output data drivers 68-1 to 68-N. More specifically, the maximum amplitude display data detecting circuit 18*a* supplies the even/odd output data driver power source circuit 24 with four types (two bits) of power source voltage switching control signals obtained as the result of detection of the most significant bit and the next most significant bit of the data signal contained in the input signal Sin. These four types of power source voltage switching control signals include, as described above, the first positive power source voltage switching control signal Svs1+ and the first negative power source voltage switching control signal Svs1− obtained as the result of detection of the most significant data bit of the data signal on the one hand and the second positive power source voltage switching control signal Svs2+ and the second negative power source voltage switching control signal Svs2− obtained as the result of detection of the next most significant data bit of the data signal on the other hand. In accordance with the power source voltage switching control signal described above, the power source voltages to be applied to the even output data drivers and the odd output data drivers can be changed substantially continuously.

The configuration of the control signal generating circuit 30 and the gate power source circuit 7 shown in FIG. 14 is basically the same as that of the first preferred embodiment shown in FIG. 16, and therefore will not be described below.

With the above-mentioned even/odd output data driver power source circuit 24, the minimum power source voltage required for displaying the display data is selected and supplied to the even/odd output data drivers 68-1 to 68-N during each one-frame period based on the four types of the power source voltage switching control signals outputted from the maximum amplitude display data detecting circuit 18*a*.

FIG. 15 shows a voltage waveform (hatched portion in FIG. 15) of the AC drive voltage outputted from the even output data drivers in the even/odd data driver and a voltage waveform (hatched portion in FIG. 15) of the AC drive voltage outputted from the odd output data drivers. In this case, the drive voltage outputted from the even output data drivers and the drive voltage outputted from the odd output data drivers, as viewed at the same time point (t), are in such a relation of reverse polarities that when one type of the drive voltages has a positive drive voltage waveform (plus drive voltage waveform), the other type of the drive voltages assumes a negative drive voltage waveform (minus drive voltage waveform).

In this case, the even/odd output data driver power source circuit 24 (FIG. 4) is capable of selectively producing a positive power source voltage and a negative power source voltage of four types of voltage levels V1 to V4 in accordance with four types of power source voltage switching control signals. Further, the even/odd output data driver power source circuit 24 generates a positive power source voltage (plus power source voltage) +Vse and a negative power source voltage (minus power source voltage) −Vse to be applied to the even output data drivers on the one hand and a positive power source voltage (plus power source voltage) +Vso and a negative power source voltage (minus power source voltage) −Vso to be applied to the odd output data drivers on the other hand.

Furthermore, the positive power source voltage and the negative power source voltage outputted from the even output data drivers and the odd output data drivers, as shown in FIG. 15, are controlled in such a manner that the polarities thereof are switched for each one-frame period, in accordance with the frame inversion signal Sfr and, at the same time, in such a manner that the magnitude thereof changes substantially continuously (in four ways, in the case under consideration) in accordance with the magnitude of the drive voltage (i.e. the voltage level).

As is obvious from the voltage waveform diagram of FIG. 15, only a positive drive voltage is outputted from the even output data drivers during a given frame period. Therefore, only the positive power source voltage +Vse is set to a voltage level proximate to the positive drive voltage range, while the negative power source voltage −Vse is set to a low voltage level (say, about 0 V). In similar fashion, only a negative drive voltage is outputted from the odd output data drivers. Therefore, only the negative power source voltage −Vso is set to a voltage level proximate to the negative drive voltage range, while the voltage level of the positive power source voltage +Vso is set low (say, about 0 V).

During the next frame period, on the other hand, only a negative drive voltage is outputted from the even output data drivers. Therefore, only the negative power source voltage −Vse is set to a voltage level proximate to the negative drive voltage range, whereas the voltage of the positive power source voltage +Vse is set low. In similar fashion, only a positive drive voltage is outputted from the odd output data drivers, and therefore only the positive power source voltage +Vso is set to a voltage level proximate to the positive drive voltage range, whereas the negative power source voltage −Vso is set to a low voltage level.

According to the above-mentioned second preferred embodiment, the number of the data drivers can be reduced by one half of the number in the first preferred embodiment. Therefore, the space occupied by the data drivers in the liquid crystal display device is reduced for a smaller size of the device as a whole. Nevertheless, in view of the need of supplying different source voltages to the even output data drivers and the odd output data drivers, it should be noted that the circuit configuration to meet this requirement is more complicated than the corresponding circuit of the first preferred embodiment.

As described above, a first advantage of the liquid crystal display device, the circuit for driving the liquid crystal display device and the method for driving the liquid crystal display device according to typical embodiments of the present invention, is that the power source voltage is changed downward for each predetermined period in the case in which the amplitude of the drive voltage outputted from the data drivers is small. Thus, unnecessary power consumption by the data drivers is saved.

A second advantage of the liquid crystal display device, the circuit for driving the liquid crystal display device and the method for driving the liquid crystal display device according to typical embodiments of the present invention, is that the display data associated with the maximum amplitude of the drive voltage outputted from the data drivers is detected for each one-frame period and a power source voltage is selected as required for displaying the display data (especially, the minimum power source voltage required for displaying the display data). Therefore, the unnecessary power consumption in the data drivers for each frame is remarkably reduced, thereby realizing lower power consumption for the device as a whole.

A third advantage of the liquid crystal display device, the circuit for driving the liquid crystal display device and the method for driving the liquid crystal display device according to typical embodiments of the present invention, is that since the display data associated with the maximum amplitude of the drive voltage outputted from the data drivers is detected in each scan bus line and a power source voltage is selected as required for displaying the particular display data, unnecessary electric power consumption in the data drivers can be effectively suppressed even in the case in which the number of the scan bus lines is increased.

A fourth advantage of the liquid crystal display device, the circuit for driving the liquid crystal display device and the method for driving the liquid crystal display device according to typical embodiments of the present invention is that since the display data associated with the maximum amplitude of the drive voltage outputted from the data drivers can be easily detected by use of the most significant bit or the like of the digital display data, the power source voltage can be changed with a simple circuit configuration and thus unnecessary power consumption by the data drivers can be saved.

A fifth advantage of the liquid crystal display device, the circuit for driving the liquid crystal display device and the method for driving the liquid crystal display device according to typical embodiments of the present invention is that after detecting the digital display data associated with the maximum amplitude of the drive voltage outputted from the data drivers, the detection result is converted into an analog signal, and therefore the power source voltage can be changed substantially continuously and unnecessary power consumption by the data drivers can be accurately suppressed.

What is claimed is:

1. A liquid crystal display device comprising:

a liquid crystal display panel including a plurality of first bus lines, a plurality of second bus lines crossing said first bus lines, and a plurality of pixels formed at the intersections of said first and second bus lines;

at least one gate driver for sequentially scanning said pixels through said first bus lines;

at least one data driver for supplying a drive voltage for displaying a predetermined display data to selected ones of said pixels on said first bus lines through said second bus lines;

a maximum amplitude display data detecting unit for detecting the display data corresponding to the maximum drive voltage having a maximum amplitude outputted from said data driver; and a variable output voltage type power source circuit portion for generating a power source voltage to be applied to said data driver and capable of changing said power source voltage based on the result of detection by said maximum amplitude display data detecting unit;

wherein said power source voltage required for displaying said display data is selected and supplied to said data driver for each predetermined period.

2. A liquid crystal display device according to claim 1, wherein the power source voltage supplied to said data driver is the minimum power source voltage required for displaying the display data corresponding to said maximum drive voltage.

3. A liquid crystal display device according to claim 1, wherein said display data are digital data, and said power source voltage is changed, stepwise, in accordance with the signal indicating the result of detection by said maximum amplitude display data detecting unit.

4. A liquid crystal display device according to claim 1, wherein said display data are digital data, and the signal indicating the result of detection by said maximum amplitude display data detecting unit is subjected to digital-to-analog conversion, and said power source voltage is changed continuously and supplied to said data driver in accordance with the signal produced by said digital-to-analog conversion.

5. A liquid crystal display device according to claim 1, wherein said power source voltage is selected and supplied to said data driver as required for displaying the display data corresponding to said maximum drive voltage for each one-frame period constituting said predetermined period.

6. A liquid crystal display device according to claim 1, wherein said power source voltage is selected and supplied to said data driver as required for displaying the display data corresponding to said maximum drive voltage in each of said bus lines for each one of said first bus lines as said predetermined period.

7. A drive circuit for a liquid crystal display device for supplying a drive voltage for displaying a predetermined display data through a data driver on a liquid crystal display panel including a plurality of first bus lines, a plurality of second bus lines crossing said first bus lines and a plurality of pixels formed at the intersections of said first and second bus lines, comprising;

a maximum amplitude display data detecting unit for detecting the display data corresponding to the maximum drive voltage having a maximum amplitude outputted from said data driver; and a variable output voltage type power source circuit portion for generating a power source voltage to be applied to said data driver and capable of changing said power source voltage based on the result of detection by said maximum amplitude display data detecting unit;

wherein said power source voltage required for displaying said display data is selected and supplied to said data driver for each predetermined period.

8. A drive circuit according to claim 7, wherein said power source voltage supplied to said data driver is the minimum power source voltage required for displaying the display data corresponding to said maximum drive voltage.

9. A drive circuit according to claim 7, wherein said display data are digital data, and said power source voltage is changed, stepwise, in accordance with the signal indicating the result of detection of said maximum amplitude display data detecting unit and supplying said power source voltage to said data driver.

10. A drive circuit according to claim 7, wherein said display data are digital data, and said power source voltage is continuously changed and supplied to said data driver in accordance with the signal obtained by digital-to-analog conversion of the signal indicating the result of detection of said maximum amplitude display data detecting unit.

11. A drive circuit according to claim 7, wherein said power source voltage required for displaying the display data corresponding to said maximum drive voltage is selected and supplied to said data driver for each one-frame period constituting said predetermined period.

12. A drive circuit according to claim 7, wherein said power source voltage is selected and supplied to said data driver as required for displaying said display data corresponding to said maximum drive voltage in each of said bus lines for each one of said first bus lines representing said predetermined period.

13. A method for driving a liquid crystal display device for sequentially scanning a plurality of pixels constituting a liquid crystal display panel through a plurality of first bus lines and supplying from a data driver a drive voltage for displaying a predetermined display data to selected ones of the pixels on said first bus lines through a plurality of second bus lines crossing said first bus lines, comprising the steps of:

detecting the display data corresponding to the maximum drive voltage having a maximum amplitude outputted from said data driver; and selecting, as a power source voltage to be applied to said data driver, and supplying said power source voltage to said data driver as required for displaying the display data based on the result of detection of the display data corresponding to said maximum drive voltage for each predetermined period.

14. A method according to claim 13, wherein said power source voltage supplied to said data driver is the minimum power source voltage required for displaying the display data corresponding to said maximum drive voltage.

15. A method according to claim 13, wherein said display data are digital data, and said power source voltage is changed, stepwise, in accordance with the signal indicating said detection result and supplied to said data driver.

16. A method according to claim 13, wherein said display data are digital data, and said power source voltage is continuously changed and supplied to said data driver in accordance with the signal produced by digital-to-analog conversion of the signal indicating said detection result.

17. A method according to claim 13, wherein said power source voltage is selected as a power source voltage to be applied to said data driver and supplied to said data driver, for each one-frame period, as required for displaying the display data corresponding to said maximum drive voltage based on the result of detection of the display data.

18. A method according to claim 13, wherein said power source voltage is selected as a power source voltage to be applied to said data driver and supplied to said data driver, in each of said first bus lines, as required for displaying said display data corresponding to said maximum drive voltage based on the result of detection of the display data.

* * * * *